US007636049B2

(12) United States Patent
Ellul, Jr.

(10) Patent No.: US 7,636,049 B2
(45) Date of Patent: Dec. 22, 2009

(54) EMERGENCY NOTIFICATION AND DIRECTIONAL SIGNALING APPARATUS

(76) Inventor: Joseph Ellul, Jr., 7037 Meadowdale Rd., Bloomfield Hills, MI (US) 48301

( * ) Notice: Subject to any disclaimer, the term of this patent is extended or adjusted under 35 U.S.C. 154(b) by 337 days.

(21) Appl. No.: 11/610,766

(22) Filed: Dec. 14, 2006

(65) Prior Publication Data

US 2007/0132575 A1 Jun. 14, 2007

Related U.S. Application Data

(60) Provisional application No. 60/750,101, filed on Dec. 14, 2005, provisional application No. 60/818,605, filed on Jul. 5, 2006.

(51) Int. Cl.
*G08B 17/00* (2006.01)

(52) U.S. Cl. ..... 340/584; 340/539.1; 340/628

(58) Field of Classification Search ..... 340/531, 340/538, 539.1, 539.14, 539.17, 539.22, 340/539.26, 584, 586, 628, 633, 629; 700/83, 700/291

See application file for complete search history.

(56) References Cited

U.S. PATENT DOCUMENTS

| | | | | |
|---|---|---|---|---|
| 3,461,283 | A | 8/1969 | Hahn | |
| 4,148,023 | A | 4/1979 | Elkin | |
| 4,283,657 | A | 8/1981 | Gordon et al. | |
| 4,489,308 | A | 12/1984 | Logan, Jr. et al. | |
| 4,517,555 | A | 5/1985 | Marsocci et al. | |
| 4,524,304 | A | 6/1985 | Todd | |
| 4,531,114 | A | 7/1985 | Topol et al. | |
| 4,540,980 | A * | 9/1985 | Porco | 340/586 |
| 4,570,155 | A | 2/1986 | Skarman et al. | |
| 4,694,285 | A | 9/1987 | Scripps | |
| 4,763,115 | A | 8/1988 | Cota | |
| 4,801,928 | A | 1/1989 | Minter | |
| 4,827,244 | A | 5/1989 | Bellavia et al. | |
| 4,901,056 | A | 2/1990 | Bellavia et al. | |
| 5,019,805 | A | 5/1991 | Curl et al. | |
| 5,140,301 | A | 8/1992 | Watanabe | |
| 5,177,461 | A | 1/1993 | Budzyna et al. | |
| 5,283,816 | A | 2/1994 | Gomez Diaz | |
| D360,156 | S | 7/1995 | Fenne | |
| 5,461,367 | A * | 10/1995 | Altavela et al. | 340/584 |

(Continued)

OTHER PUBLICATIONS

HITEC Group International, Inc. 1996 Catalog, Copyright 1995, HITEC Group Int'l, Inc.

(Continued)

*Primary Examiner*—Van T. Trieu
(74) *Attorney, Agent, or Firm*—Young, Basile, Hanlon & MacFarlane P.C.

(57) ABSTRACT

An emergency notification and directional signaling apparatus includes an alarm remotely mountable from and responsive to an emergency event detector and alarm. The remote alarm activates one of a supplementary visual and audible alarm which may include one or more different colored lights, one of which is a pulsed strobe, and an audible sound which may include a recorded voice message. A temperature sensor in the remote alarm housing activates a second notification and signaling event when the ambient temperature surrounding the remote alarm reaches a preset threshold. The remote alarm may be mounted in a portable housing, on a faceplate of an existing wall electrical junction box, or in an electrical duplex body mounted in a junction box.

40 Claims, 19 Drawing Sheets

U.S. PATENT DOCUMENTS 5,570,077 A 10/1996 Swieboda
5,578,989 A 11/1996 Pedtke
5,587,705 A 12/1996 Morris
5,594,410 A 1/1997 Lucas et al.
5,825,280 A 10/1998 Merendini et al.
5,889,468 A 3/1999 Banga
5,898,369 A 4/1999 Godwin
6,133,839 A * 10/2000 Ellul et al. ..... 340/584
6,249,221 B1 6/2001 Reed
6,993,417 B2 * 1/2006 Osann, Jr. ..... 700/291

OTHER PUBLICATIONS

ADA Enterprises, Inc., Product Catalog, Nov. 20, 1997.
International Preliminary Report on Patentability dated Jun. 16, 2009 for PCT/US2007/087097.
Written Opinion of the International Searching Authority dated Apr. 29, 2009 for PCT/US2007/087097.

* cited by examiner

EMERGENCY NOTIFICATION AND DIRECTIONAL SIGNALING APPARATUS

CROSS REFERENCE TO CO-PENDING APPLICATIONS

This application claims priority benefit to the filing date of U.S. Provisional Patent Application Ser. No. 60/750,101 filed Dec. 14, 2005, and to the filing date of U.S. Provisional Patent Application Ser. No. 60/818,605, filed Jul. 5, 2006.

BACKGROUND

The present disclosure relates, in general, to emergency event detectors, alarms and signaling devices, such as smoke detectors, carbon monoxide alarms, etc.

Emergency event alarms, such as smoke alarms, carbon monoxide alarms, heat alarms, etc., are typically mounted in various rooms of a home, such as bedrooms, hallways and at one or both ends of stairs to provide an early indication of the presence of heat or smoke generated during the initial stages of a fire, for example, or carbon monoxide from a faulty furnace, to enable the occupants to safely escape from the home.

It is also known to construct smoke alarm warning systems which include a light source to provide emergency illumination. Such devices are typically employed in hallways and similar exit areas of a building and come into play when the main power supply of the building fails during a fire. The high intensity flashing strobe light is capable of being seen despite intense smoke which may fill a hallway or room. Nevertheless, such smoke detector/light warning systems do provide an indication of an exit to enable an occupant to escape from a burning building or home.

It is also known to provide a smoke alarm/warning light system which includes a standard smoke alarm mountable in a normal location on the ceiling of a room and a remote, separate light indicator unit which includes a light and a microphone for receiving the audible alarm signals generated by the smoke alarm sound generator. The flashing light housing is designed to be mounted on a window for visibility exteriorly of the building to identify the room where smoke has been detected so that rescuers will know where to go to put out the fire and/or rescue occupants of a burning building or home. This device utilizes a radio frequency transmitter in the smoke alarm and a receiver in the light housing. The radio frequency signals can activate light devices which may be remote from the smoke alarm and not positioned to detect the audible sounds generated by the smoke alarm.

The present Applicant previously devised a smoke detector apparatus with emergency escape indicator as described in U.S. Pat. No. 6,133,839. This apparatus included a temperature sensor which sensed ambient temperature adjacent to the remote alarm device mounted adjacent a building exit, such as a door, opening, window, etc., and generated a visible and/or audible alarm to lead people to the exit despite the presence of smoke, noxious fumes, etc.

Despite the advantages provided by Applicant's prior apparatus, it is believed that further improvements can be made to provide an easy-to-use, easily visible device which can act as a supplementary emergency event indicator to assist in directing individuals within a smoke or noxious fume-filled room to a safely usable exit.

SUMMARY

An emergency notification and directional signaling apparatus uniquely provides a safe and/or non-safe indication of an exit from a building or room within a building in the event of a detected fire, excess carbon monoxide, etc. The remote alarm housing of the present invention is mountable adjacent to any escape surface, such as a door, window, etc. The use of at least one and preferably both a visible light and an audible alarm in the alarm housing provides enhanced safety by leading an occupant to a safe exit both visually and audibly, even if the room is filled with dense smoke.

A temperature sensor senses the air temperature adjacent to the remote alarm and, if a temperature exceeding a predetermined safe temperature is detected, such as would occur in the event of fire, is sensed, the temperature sensor output signal, through a control circuit, caused a second notification event to take place, such as the activation of a different color lamp to suggest caution when using that exit.

According to one aspect, the apparatus includes a receiver capable of sensing and generating an output signal indicative of the activation of an audible output from an emergency event alarm and detector. A transmitter is responsive to the output signal of the receiver for transmitting a second signal frequency upon receiving the signal from the alarms. The receiver and transmitter are mounted separately but in proximity to the emergency event alarm. The receiver may be responsive to the emergency event alarm activation output by a hardwired connection to the output or a microphone capable of receiving the audible sounds generated when the emergency event alarm and directional signaling output is activated.

At least one distinct device or alarm and/or notification device, both hereafter referred to as a remote alarm, is remotely mounted from the main alarm on a surface in close proximity to the escape exit. The remote alarm includes a light source capable of generating visible light and a receiver responsive to a preset frequency signal from the transmitter. The receiver activates the alarm upon receiving the frequency signal from the transmitter. The alarm includes at least one or both of a visible light source and an audible alarm. The light may be a pulsed strobe light.

The remote alarm may be configured for mounting in an electrical outlet or switch junction box and/or on the faceplate or cover of such a junction box. In another aspect, the remote alarm is mounted in the outlet or switch body which is mounted in the junction box and carries a switch or an electrical outlet.

In yet another aspect, the audible alarm may be a voice message which is prerecorded and stored in the remote alarm. Any emergency message, as well as a message providing exit instructions, may be recorded. The message may be a recorded message pre-stored in the remote alarm or a recordable message enabling a customer to prerecord in their own voice a message suitable to their living conditions and which may be more readily understood and followed by children.

In yet another aspect, the light source includes at least two different colored lights, one of which may be a pulsed white light strobe. One or more second color lights may be provided as an indication of caution. The second colored light(s) is activated by the temperature sensor in the remote alarm when the ambient temperature surrounding the remote alarm reaches a preset first temperature. The second light(s) thus advise caution when using the exit.

BRIEF DESCRIPTION OF THE DRAWING

The various features, advantages and other uses of the present apparatus will become more apparent by referring to the following detailed description and drawing in which.

DETAILED DESCRIPTION

Figure 1:
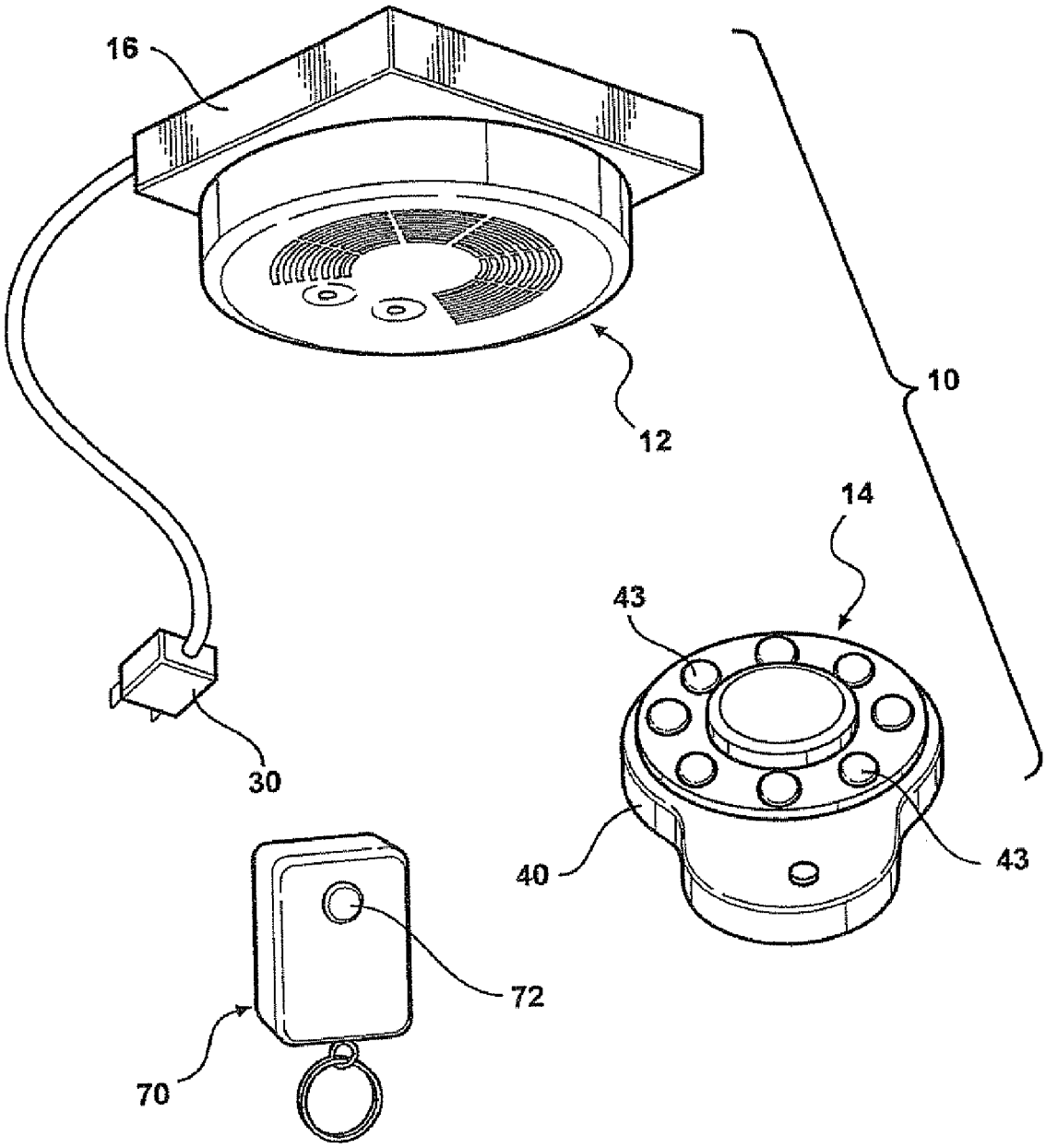
FIG. 1 is a perspective view of the components of one aspect of an emergency notification and directional signaling apparatus.

Referring now to FIG. 1, there is depicted an emergency notification and directional signaling apparatus 10, by example, which includes a smoke alarm 12, which includes a smoke detector, carbon monoxide detector or heat sensor, and a remote alarm 14.

The smoke alarm 12 may be any conventional, commercially available smoke alarm which is capable of detecting smoke and generating an output signal typically used to activate an alarm and includes a housing that may take any shape. The smoke alarm 12 may be connectable to 110 VAC power, internal replaceable batteries and/or 110/220 VAC power with battery backup adapted for trickle recharging when AC power is available.

Although the following description of the alarm 12 describes the alarm 12 as a smoke alarm detector, it will be understood that the term "alarm" and "detector" includes a smoke alarm and detector, a carbon monoxide alarm and detector capable of detecting carbon monoxide levels or a heat alarm, all of which generate an alarm when the detected levels exceed a preset threshold.

Figure 2:
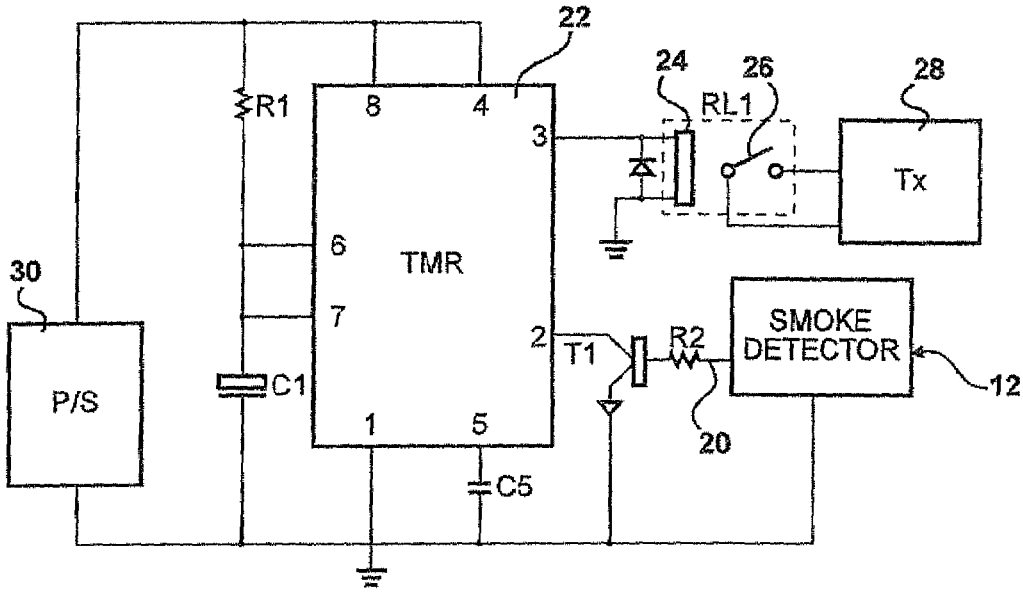
FIG. 2 is a schematic diagram of the detector and transmitter circuit of the apparatus.

A housing 16 is connected to the smoke alarm 12 housing and contains an emergency notification and directional signaling circuit described hereafter and shown in FIG. 2. Alternately, the circuitry could be contained wholly within the smoke alarm 12 housing and may take any shape or form.

Before describing the circuitry of FIG. 2, it will be understood that although the following discussion describes the audible alarm as mounted in the alarm 14, and not in the smoke alarm 12, as is more conventional, the present apparatus may still utilize the conventional audible alarm in a smoke or carbon monoxide alarm as the main fire/smoke alarm.

As shown in FIG. 2, power is supplied to an alarm circuit by a power supply 30. As described above, the power supply 30 may be, by example, a DC power supply formed of a replaceable and/or rechargeable storage batteries contained within the housing 16. The DC power supply 30 may be a 12 volt DC power supply with internal battery backup. Such a power supply 30 utilizes a transformer which is connected to 110/220 volt AC and a rectifier bridge to convert the AC power to the DC power levels required for the integrated circuits and other electronic components of the detector circuit shown in FIG. 2. As is conventional, battery backup may be provided for the power supply 30 which is activated when the main AC power is interrupted.

The detector circuit shown in FIG. 2 is electrically connected to an output 20 of the smoke alarm 12. As is conventional, when smoke enters the chamber of the smoke alarm 12, a 2 Hz output pulse or signal develops across an internal capacitor within the smoke alarm 12. This output signal 20 is connected through resistor R2 to the base of transistor T1 and drives transistor T1 into conduction which brings pin 2 of a timer 22 low or to ground. The timer 22 may be any conventional timer, such as an integrated circuit timer model No. NE555P. The purpose of the timer 22 is to stretch 2 Hz output signal 20 from the smoke alarm 12. Any output time period may be selected by the use of appropriate sized resistor R1 and capacitor C1.

As also shown in FIG. 2, capacitor C5 is connected between one pin of the timer 22 and ground and acts as a spike arrestor.

As soon as pin 2 of the timer 22 goes low or to ground, output pin 3 of the timer 22 goes high for a time period set by resistor R1 and capacitor C1 connected to input pins 6 and 7, respectively, of the timer 22. For example, appropriate values are selected for R1 and C1 to create a 5 second time period output. Thus, in this example, the output on pin 3 of the timer 22 goes high for five seconds and activates a coil 24 of a relay RL1. When the coil 24 is activated, the switchable contact 26 of the relay RL1 closes and supplies power to the trigger pin of a transmitter means 28.

In one aspect, the transmitter means 28 is a transmitter capable of generating a wireless signal within a preset range or distance, such as 50 feet, for example. The wireless signal may be an ultrasonic, microwave or radio frequency signal. Further, at least in the case of radio frequency signals, a selector switch may be provided on the housing 16 and an associated receiver in the remote alarm 14 to provide a selection of discrete communication frequencies so as to avoid interference with the radio frequencies employed by other wireless devices typically found in a home or building, such as garage door openers, television remote controls, etc.

If, at the end of the five second time period, smoke is still detected by the smoke alarm 12, the output signal 20 from the smoke alarm 12 will still be present thereby causing the timer 22 to restart a new time period and continue to supply a high output from pin 3 to maintain the coil 24 of relay RL1 activated and the transmitter 28 continuing to transmit a frequency signal.

Figure 5:
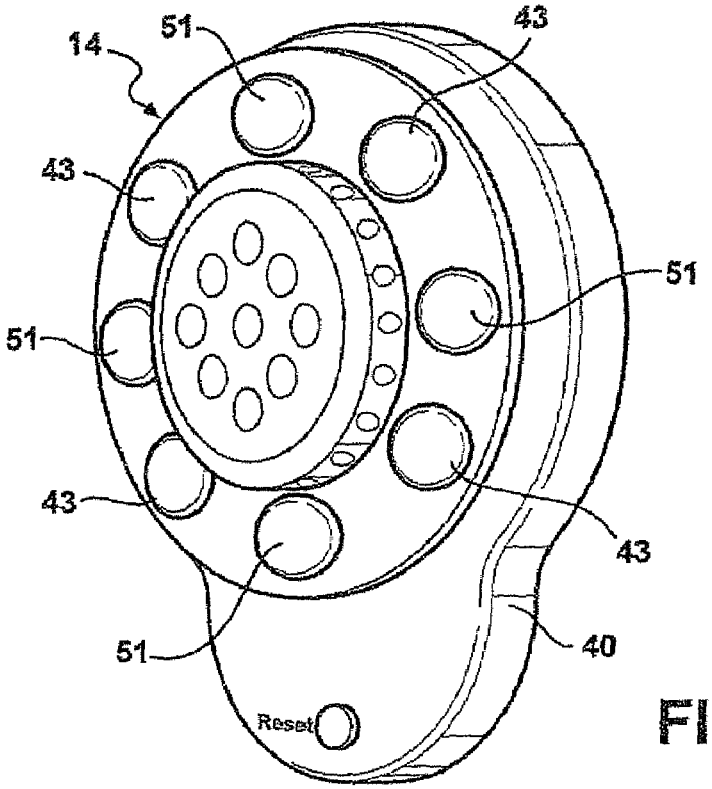
FIG. 5 is a perspective view of one aspect of the receiver and indicator device of the apparatus.

As shown in FIGS. 1 and 5, the alarm 14 includes a housing 40 which may take any shape. The housing 40 supports one or more printed circuit board(s) carrying the receiver circuit shown in FIG. 3. One or more lights 42 are mounted in the housing 40 and project from the housing 40 for external visibility. Vents 44 may also be formed on the front of the housing 40 and or on the sides of the housing 40 to allow audible sounds to escape from the housing 40.

Figure 3:
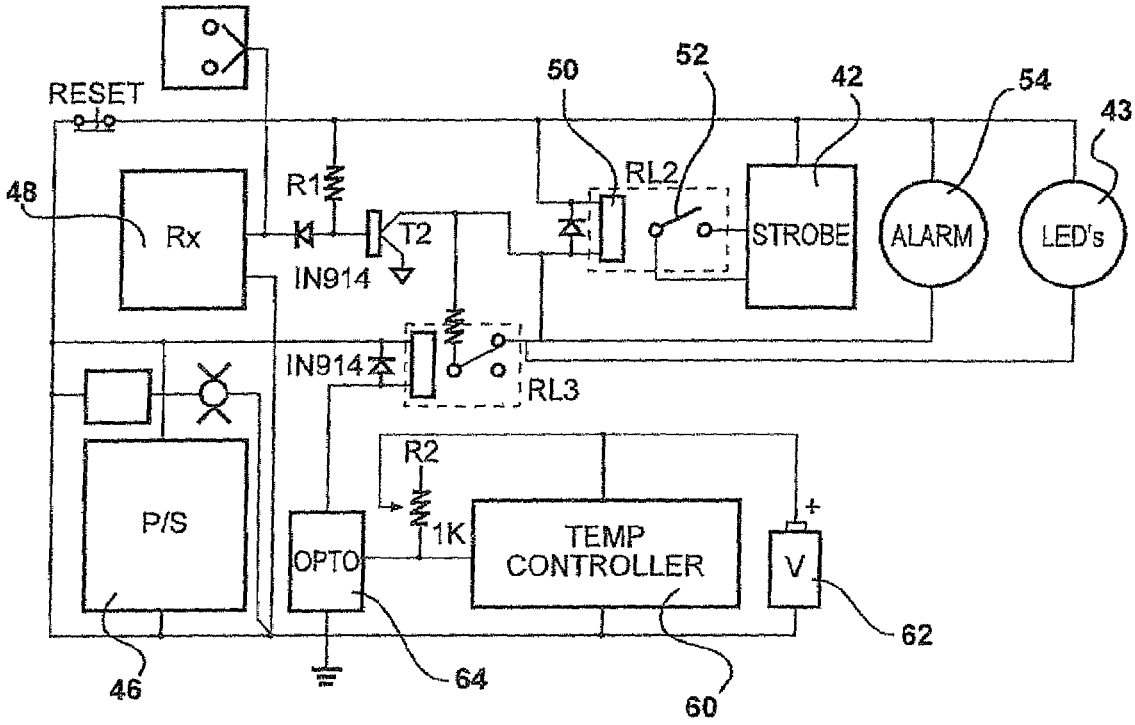
FIG. 3 is a schematic diagram of the receiver and alarm circuit of the apparatus.
Figure 4:
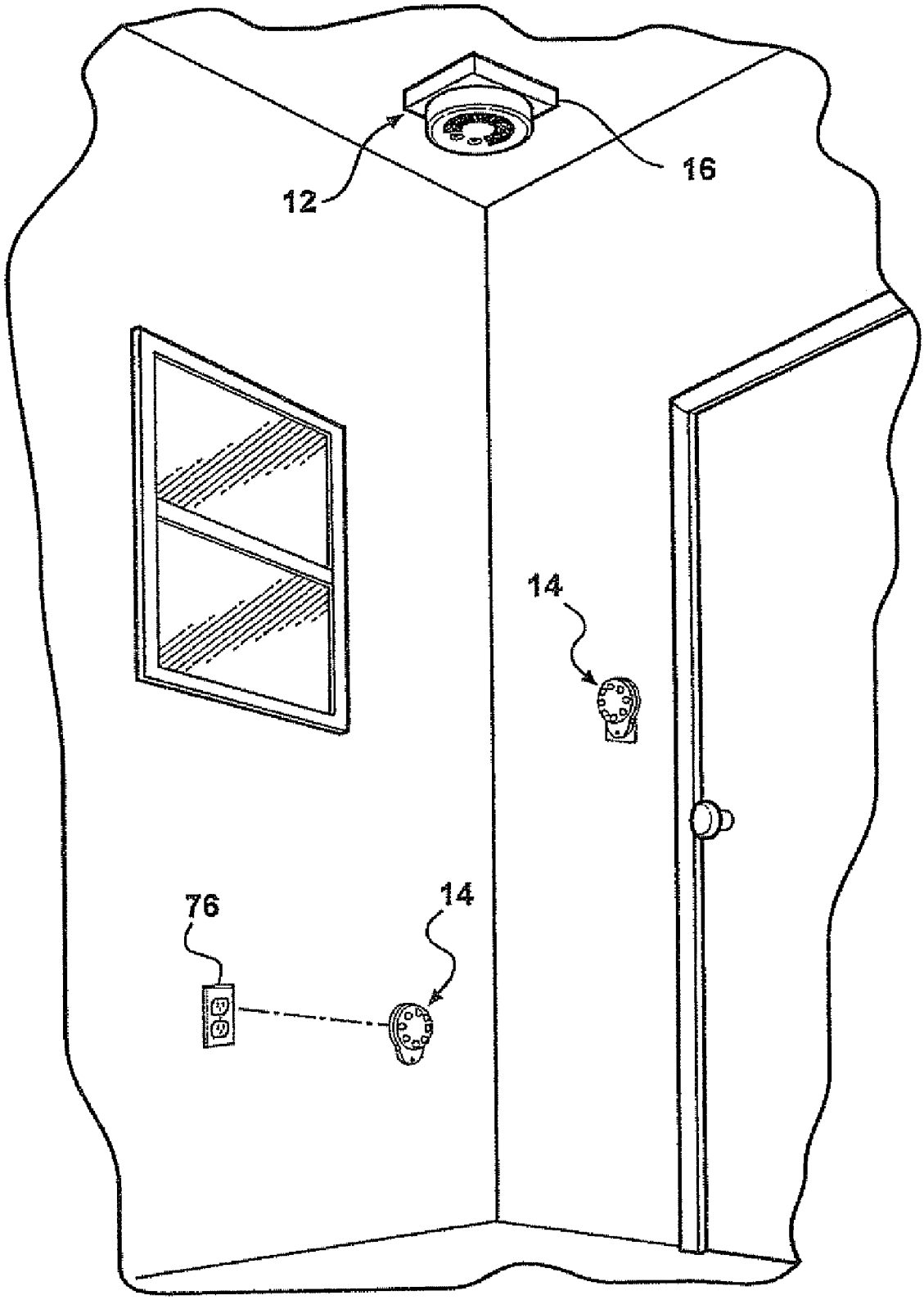
FIG. 4 is a perspective, pictorial representation of the mounting positions of the apparatus.

The light(s) 42 may be high intensity strobe lights, or one or more high intensity light LEDs 43. If a plurality of light LEDs 43 are employed, they can be arranged in any suitable pattern, such as a closely adjacent group or, as shown in FIG. 4, in an approximate circle with each individual light LED 43 equally circumferentially spaced from adjacent white LED's 43. Each white LED 43 is contained within a transparent dome, such as a polycarbonate dome 45, and a 120° reflector, by example only. By example only, the white LED strobe lights 43 emit a total of 177 Candella at sixty (60) flashes per minute As shown in FIG. 3, the receiver is provided with a separate power supply 46 such as a 12 volt DC power supply with battery backup. Alternately, 110/220 volt AC power or even storage batteries may be employed as the power supply 46.

The receiver circuit also includes a receiver 48 capable of detecting the frequency signals generated by the transmitter 28.

In operation, when the receiver 48 detects a matching frequency signal from the transmitter 28, an output from the receiver 48 drives transistor T2 into conduction which supplies power to the coil 50 of relay RL2. Activation of the coil 50 causes the switchable contact 52 of the relay RL2 to close thereby supplying power to the lights 42. It should also be noted that transistor T2, when driven to conduction by an output from the receiver 48 also supplies power to an audible alarm 54, by example, but higher and lower volume or db levels may also be used.

Alternately, the alarm 54 can be a high and low tone warble sounding device which can be effective for waking children and/or adults that have a high frequency hearing loss, and/or any other appropriate sound and volume that may be used as an audible emergency notification and/or directional signal, such as temporal, a human voice, a computer generated electronic voice, a siren or a directional sound.

According to one aspect, a temperature sensing means is provided for sensing the ambient temperature of the air surrounding the exit immediately adjacent the alarm housing 40.

In one aspect, the temperature sensing means includes a thermistor or probe 56 which is connected by a conductor 58 to a temperature controller or comparison circuit within the housing 40. Alternately, a thermistor may be mounted within the housing 40 adjacent to the air vents 44.

By way of example only, the temperature sensing means can be a temperature controller 60, model No. HED043, which is provided with its own 1.5 volt battery power supply 62. The temperature controller 60 includes an adjustable high temperature set point. When the set point is exceeded by a temperature reading from the thermistor 56, the controller 60 generates an output signal on pin 3 which goes high for ten seconds and triggers an optocoupler 64. When triggered, output pin 5 of the optocoupler 64 goes low to activate a coil 66 of a relay RL3. When the coil 66 is activated, the normally closed switchable contact 68 of relay RL3 opens disconnecting power to the coil 50 of relay RL2 and the audible alarm 54. This immediately deactivates the strobe light(s) 42 and the audible alarm 54.

Alternately, contact 68 of relay RL3 may be connected to activate a second notification event, such as different colored lights, or a different voice message, or both, as described hereafter.

In use, as shown in FIG. 4, the smoke alarm 12 is mounted in one of the normal locations within a room typical for smoke alarm, such as on the ceiling of a room. The smoke alarm 12 is connected to 110 AC electrical power or provided with its own internal battery power, or both.

Figure 7:
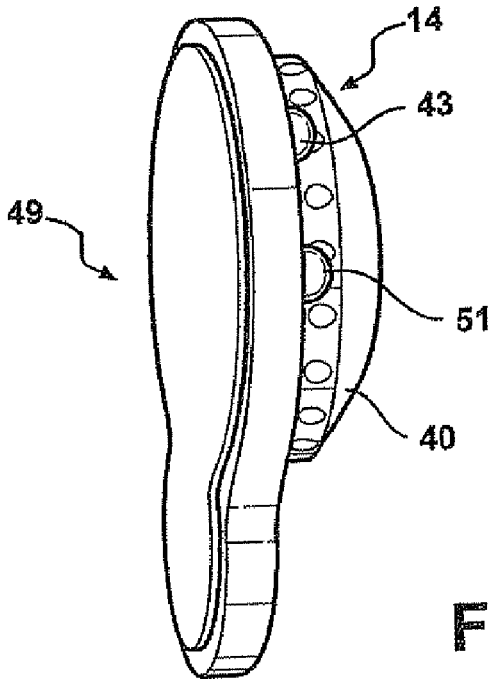
FIG. 7 is a rear left side perspective view of the device shown in FIG. 5.

One alarm 14 can be mounted immediately adjacent to one exit from the room. Possible locations include on or immediately adjacent to a door controlling access to the room from an adjacent room, hallway etc., a window or an open archway opening into an adjacent room or hallway. The alarm 14 could also be mounted on a door opening to a stairway from a hallway. The alarm housing 40 is mounted to such a surface by conventional fasteners or by peel and stick two-way tape 49 shown in FIG. 7. Since the mounting locations may vary, the housing 40, as described above, can be provided with power supplies including storage batteries thereby enabling the housing 40 to be mounted at any desired location without regard to the availability of AC electric power. As shown and described later in conjunction with FIGS. 23A, 23B, and 23C, the housing 40 may be provided with a conventional electric outlet plug terminals, enabling the housing 40 to be plugged into a conventional 110 VAC electrical output 76. This application would be suitable where an electric outlet is located in close proximity to a doorway, window or other room exit.

With both the smoke alarm 12 and the remote alarm(s) 14 are a power-on or active state, the smoke alarm 12 will generate an output signal upon detecting smoke within an internal chamber within the smoke alarm 12. A wireless signal is transmitted by the transmitter 28 over an area, such as through an entire room or up to 50 feet, for example, and is received by all of the alarms 40 within the range the transmitter 28. As described above, when the receiver 48 of the alarm 40 receives a matching frequency signal, electric power is immediately supplied to the audible alarm 54 and, through relay RL2, to the strobe light 42 (LEDs 43) thereby providing an audible indication as well as a visual indication of the location of an exit by the flashing high intensity strobe lights 43 and the audible sound.

It will be understood that multiple alarms 14 may be employed in a single room, each identifying a different exit from the room. This increases the safety for the occupant(s) of the room since multiple exits are indicated. Each of the remote alarms 14 will be keyed to the same frequency of the transmitter 28 in the alarm circuit of the smoke alarm 12 so as to be activated at the same time.

However, if the temperature sensing means of any alarm 14 detects a temperature exceeding the preset high temperature set point, 120° F., for example, the temperature sensing means will cause the strobe light 42 and the audible alarm 54 to be deactivated or a second event to occur, as described above. The other alarms 14 within the room will not be effected and can still direct an occupant to a safe exit where the ambient temperature is lower than the set point temperature sensed by one alarm 14.

Since the smoke alarm 12 is activated by smoke, the presence of dense smoke may initially confuse an occupant of a room when awakened or otherwise alerted by the activation of the various audible alarms 54 on the alarm devices 14 spaced throughout a given room. Those audible alarms 54 and strobe lights 42 associated with safe exits will be activated. The audible alarm 54 can still be heard through the smoke and the high intensity strobe 42 will be visible to lead an occupant safely from the room through a safe exit.

Figure 6:
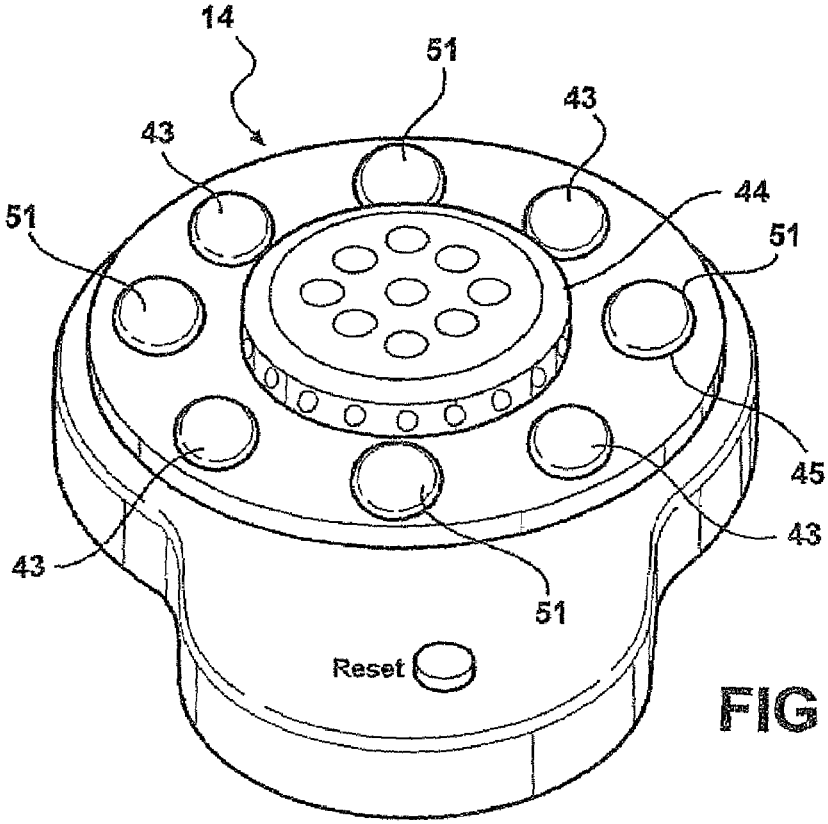
FIG. 6 is a bottom front perspective view of the device shown in FIG. 5.

Referring again to FIG. 5 and to FIG. 6, in another aspect, one or more different colored lights, such as LEDs 51, are also carried on the housing 40. The second set of LEDs 51, can be of any color, with yellow being one example, with blue, red, green, etc. being also possible. Each LED 51 is enclosed with a protective dome formed of a suitable plastic, such as polycarbonate, for example, and has a 120° reflector so as to be visible over a wide field of view.

The LEDs 51 may be arranged on the housing 40 in any pattern. By example only, the LEDs 51 are interspersed in a circular arrangement with the white strobe LEDs 43.

Figure 9:
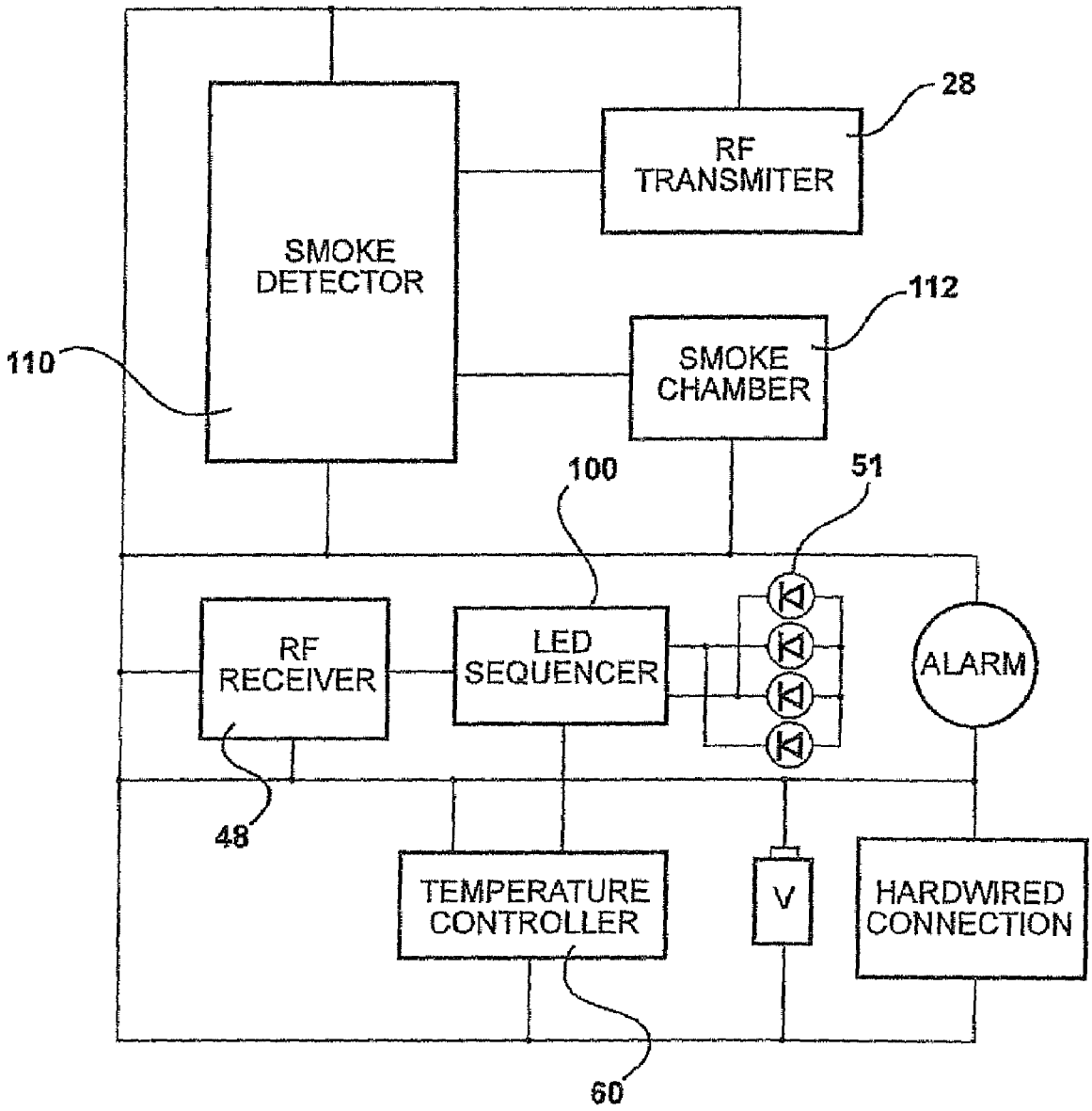
FIG. 9 is a block diagram of the circuit elements contained within the device shown in FIG. 8.

As shown in FIG. 9, an LED sequencer or circuit 100 is connected to the output of the temperature control in the receiver 48. The LED sequencer or circuit 100, which may include the relay RL3 shown in FIG. 3, controls the second color LEDs 51. In this aspect, the high temperature set point of the temperature controller 60, such as a 120° F., by example only, is generated when the ambient temperature reaches the set point temperature. An output from the temperature controller 60 activates the optocoupler 64, which can be connected to a different contact of the relay RL3, to activate and illuminate the second color of LEDs 51. It should be noted that the strobe or light LEDs 43 remain illuminated in a strobe-like or flashing manner to indicate the location of a building or room exit. The different color or yellow LEDs 51 provide a caution warning to a person within the room or building that the ambient temperature of the air surrounding the alarm 40 is high. It is then the individual's choice of whether or not to use the exit.

Figure 10:
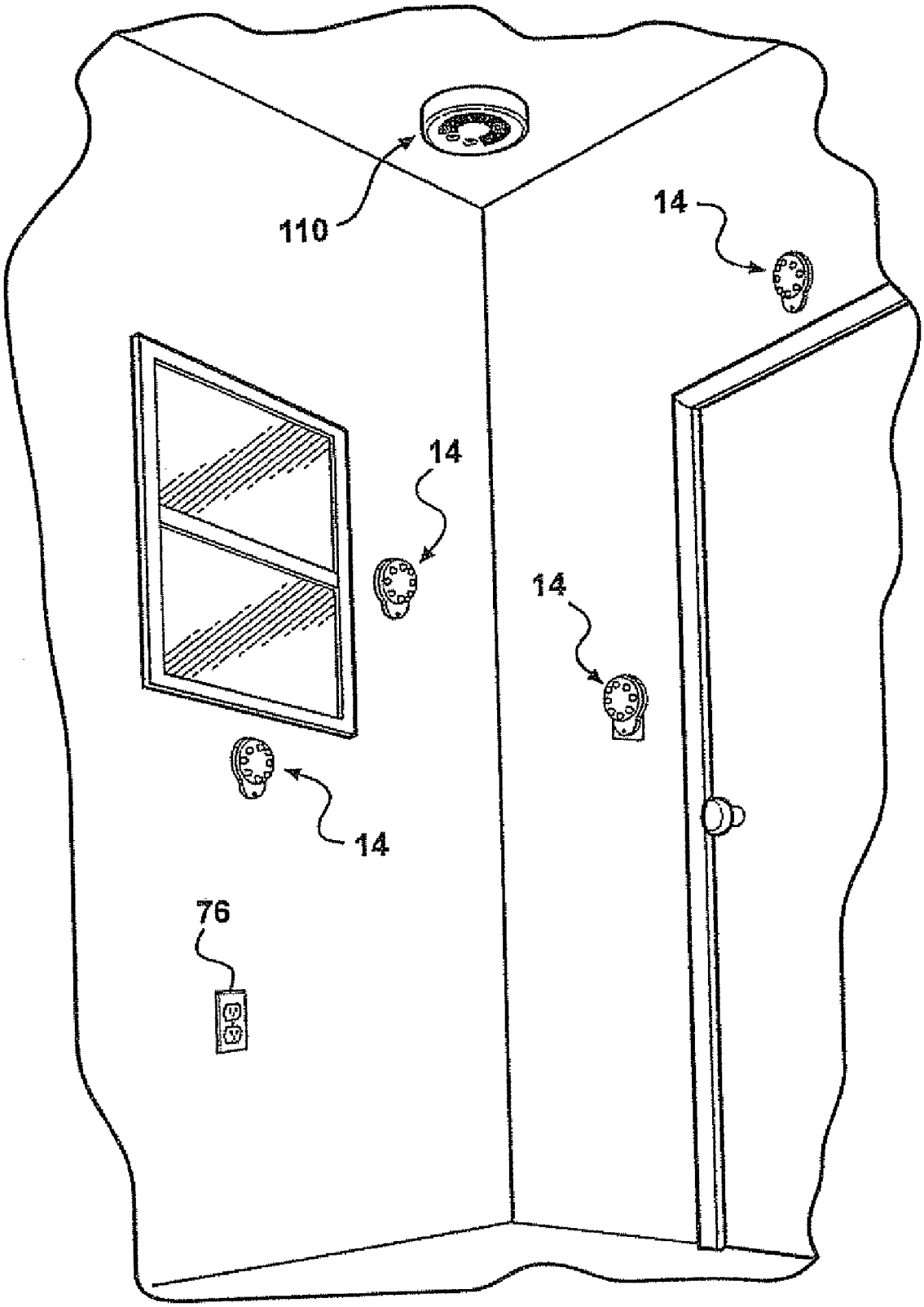
FIG. 10 is a perspective view showing possible mounting positions of the device shown in FIG. 8.
Figure 11:
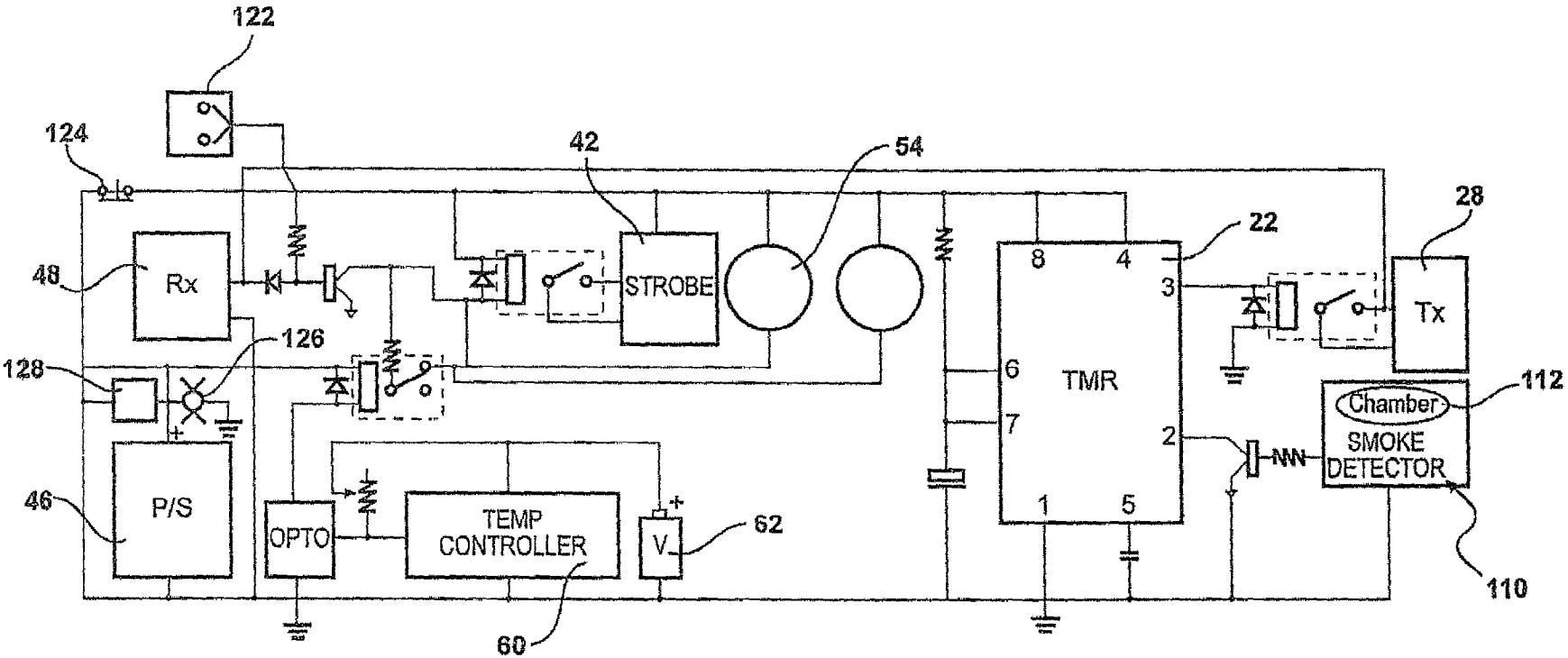
FIG. 11 is a schematic diagram of the circuitry employed in the device shown in FIG. 8.
Figure 12:
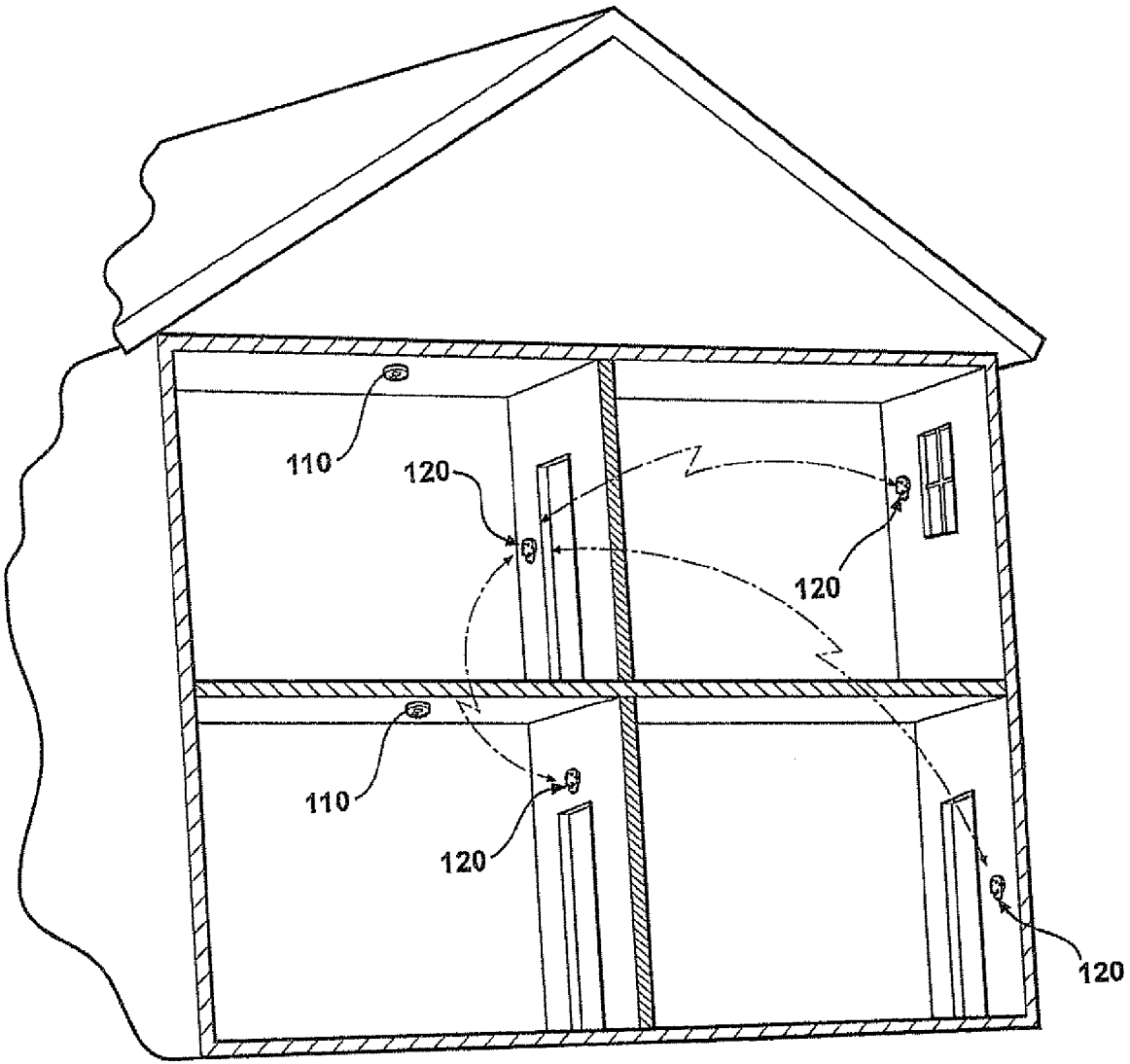
FIG. 12 is a pictorial representation of one aspect of the device shown in FIG. 8.

Referring now to FIGS. 10 and 11, another aspect of a combined smoke alarm emergency notification and directional signaling device is depicted in which the housing 40 of the alarm 14 includes an internal smoke detector 110 with its own collection chamber 112. The chamber 112 communicates with openings 114 formed in the front face of housing 40 within the housing 40 to allow smoke to enter the smoke chamber 112 within the interior of the housing 40. The smoke chamber 112 in the detector 110 can be any suitable type, such as a photoelectric or an ionization chamber, etc. The output of the smoke detector 110 is connected to the timer 22. The alarm and receiver circuitry shown in FIGS. 2 and 3 are contained in one or more circuit boards within the housing 40 shown in FIG. 8. The output of the relay RL1, which is "on" when an output signal from the smoke detector 110 is generated, is coupled to the transistor T1 and the relays Rl1 and RL2 to turn on the alarm 54 and the strobe lights 42. The transmitter 28 and the receiver 48, in this aspect, may be employed to generate and receive a wireless, radio-frequency or microwave signal when the two components communicate between each of the housings 40 in a building or house, as shown in FIG. 12. In this manner, the sensing of smoke by any one alarm 120 will activate all of the alarms 120 within a predefined area, such as a house, a building, the floor of a building, etc.

Also shown in FIG. 11, is a hardwired connector or connector 122 which may be connectable to a building central alarm system to provide an alarm signal to activate the alarm 54 and the strobe 42 from a central alarm controller. A reset push button 124 is also mounted on the housing 40 to reset the operation of any individual alarm after activation, testing, etc.

Also shown in FIG. 11 is an audible low battery indicator or LED 126, which may also be mounted on the housing and connected to the output of a current detector 128 which generates an output signal when the current flow from the power supply 46 decreases below a threshold to indicate minimal power left in the storage batteries forming the power supply 46.

Figure 8:
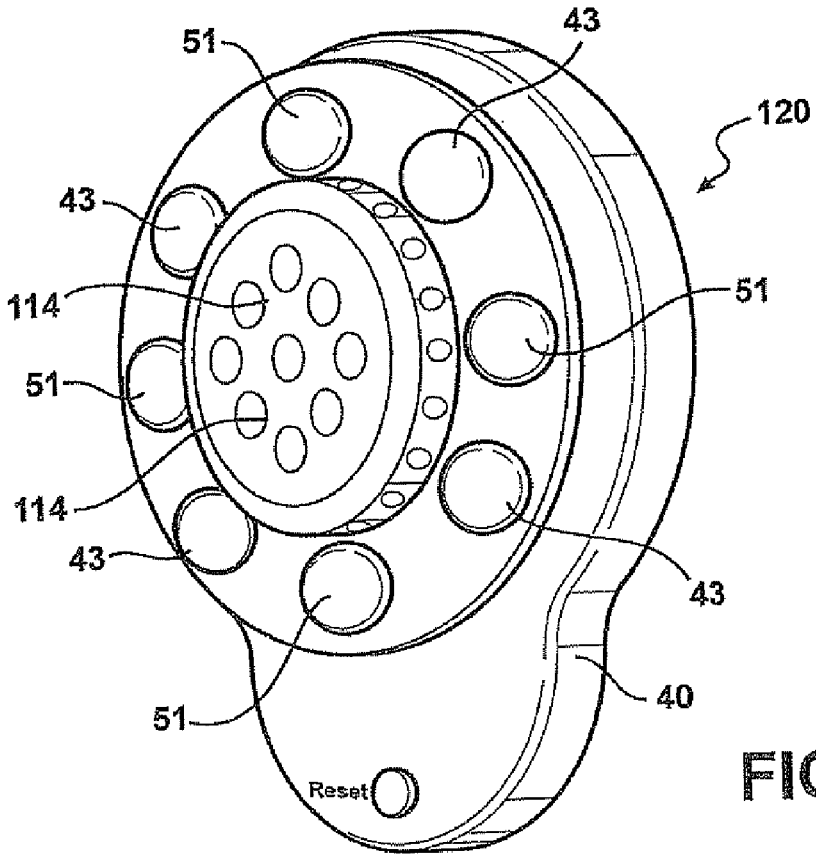
FIG. 8 is a front perspective view of another aspect of the device, similar to FIG. 5.
Figure 13:
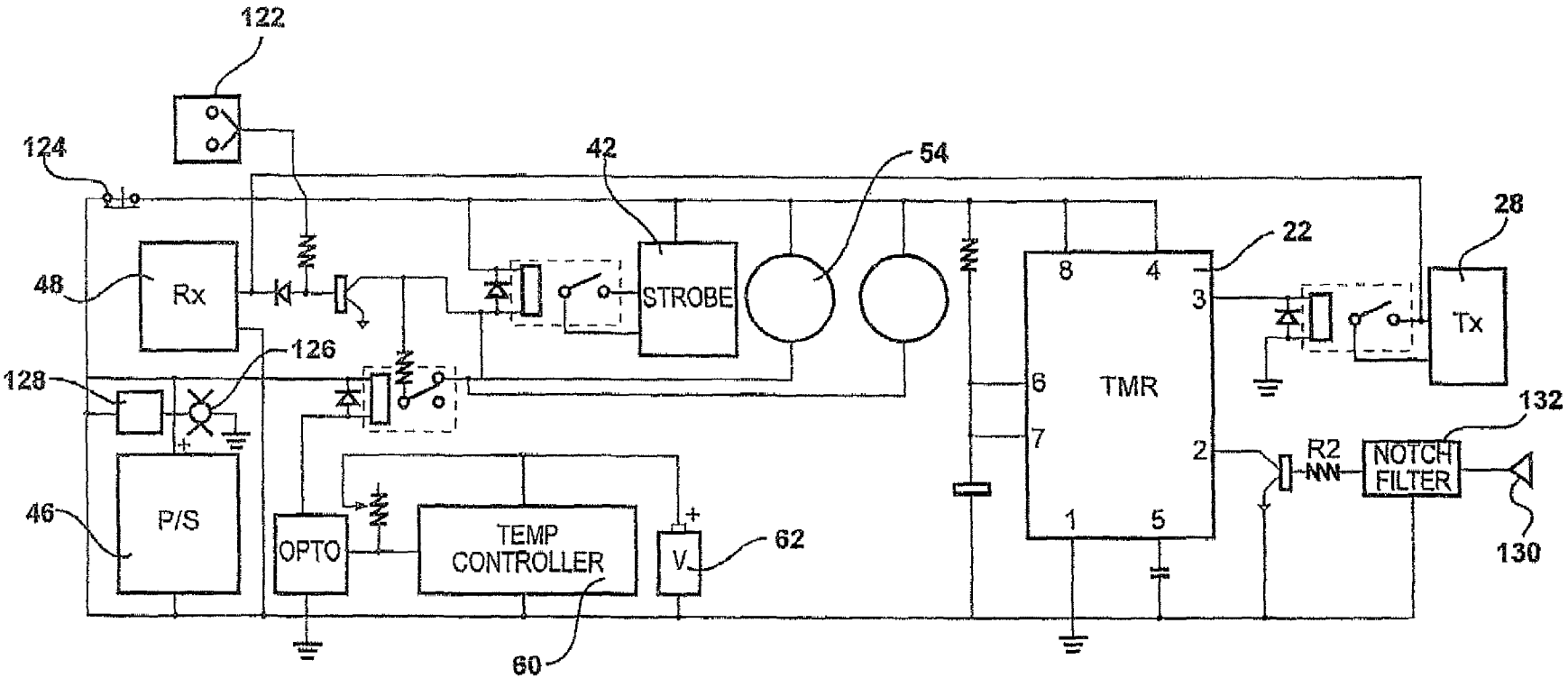
FIG. 13 is a schematic diagram of another aspect of the receiver and alarm circuits of the present apparatus.

In another aspect shown in FIG. 13, the same housing 40 shown in FIG. 8 is employed. In this aspect, however, the openings 114 in the housing 40 allow the audible sound from the smoke alarm 12 to be received by a microphone 130 mounted within the housing 40. The microphone 130 and notch filter 132 are selected to detect the output signal frequency of a smoke alarm or carbon monoxide alarm 12. The detector output activates the timer which generates a signal to activate the transmitter 28, in the configuration shown in FIG. 3. The transmitter 28, in the configuration shown in FIG. 11, is directly coupled through the circuitry also shown in FIG. 3 to activate the alarm 54 and the strobe lights 42 in the housing 40.

A remote test device 70 shown in FIG. 1 may optionally be provided. A remote test device 70 is capable of remotely testing the alarm 14. A housing includes a pushbutton 72 which, when depressed, activates an internal transmitter which can be identical to the transmitter 28 in the alarm circuit. The transmitter generates a signal which is received by the receiver 48 in each alarm 14 and causes each alarm 14 to activate its respective strobe light 42 and audible alarm 54. In this manner, proper operation of each alarm 14 can be checked without generating smoke adjacent to the smoke alarm 12. The smoke alarm 12 can be tested by depressing the push button 7 on the smoke alarm 12.

Referring now to FIGS. 14A, 14B, 15A, and 15B, there is depicted another aspect of a mount for the alarm 12 and the remote alarm 14.

Figure 14A:
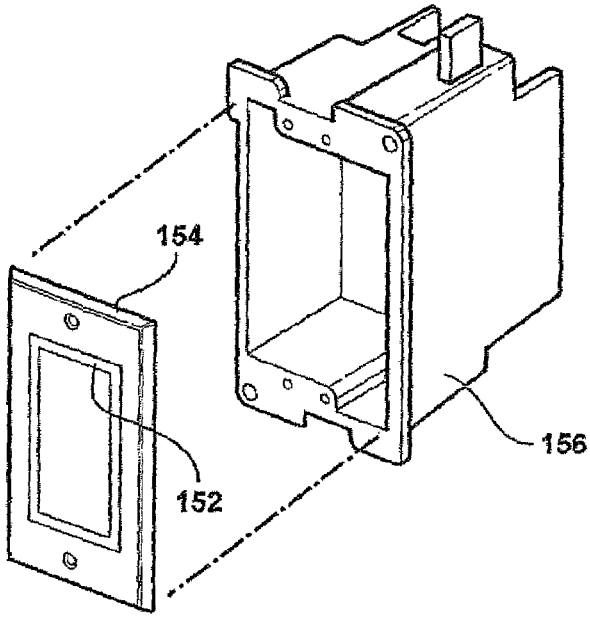
FIG. 14A, 14B are respectively perspective and side elevational views of one aspect of a box mount for a smoke detector, such as shown in FIG. 2.
Figure 14B:
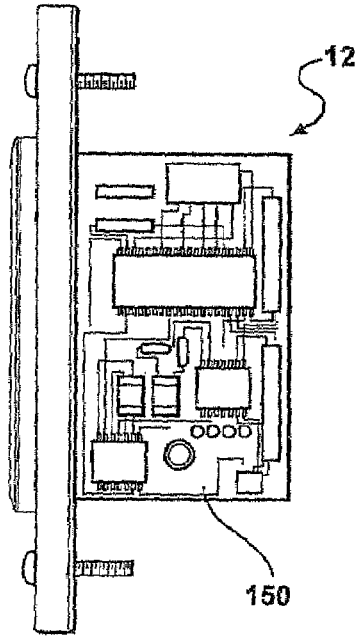

As shown in FIGS. 14A and 14B, the alarm 12 includes one or more circuit boards 150 on which the operative components shown in FIG. 2 or 11, for example, are mounted. The smoke detection chamber 112 is carried on a cover plate 152 which is attachable to a junction box 156 mountable to the joists in a ceiling.

Figure 15A:
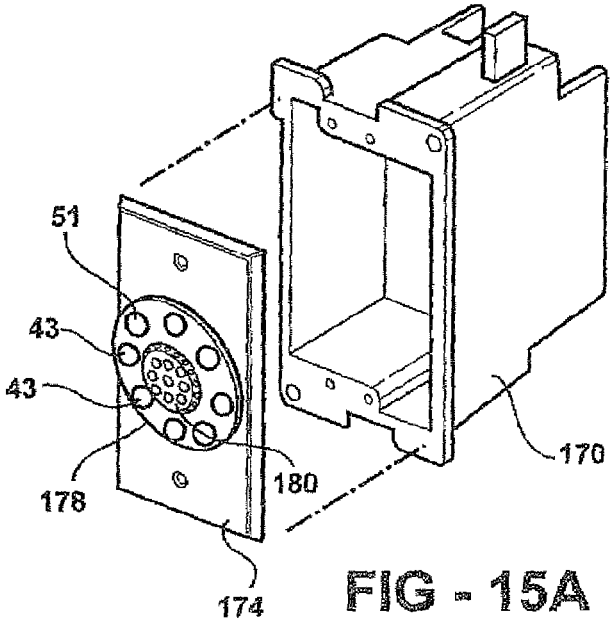
FIGS. 15A, 15B are respectively perspective and side elevational views of a box mount for an alarm shown in FIGS. 3 and 11.
Figure 15B:
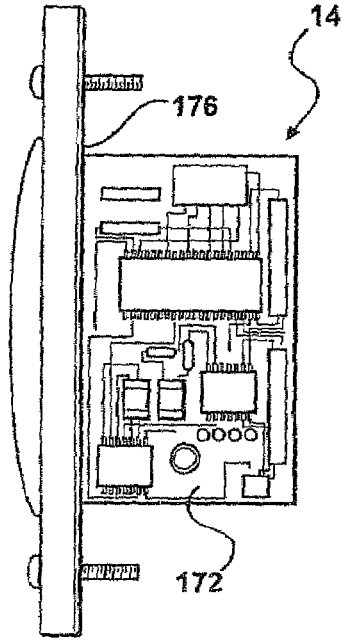

The circuit in the alarm 14 includes one or more circuit boards l72, FIGS. 15A and 15B which are mounted on a cover plate 174. The one or more circuit boards includes a circuit board 176 mounted on the rear surface of the cover plate 174 for supporting the individual LEDs 51, 43, as described above. The cover plate 174 is attachable to a junction box 170 by fasteners. The junction box is mounted to wall joists, for example.

A raised boss 178 is formed on the outer or front surface of the plate 174 and provides a mounting surface for the LEDs 43 and 51, as well as the raised center boss 180 which carries openings for allowing smoke to enter the smoke chamber 112 mounted inward from the rear surface of the plate 174, for audible alarm sound to exit the junction box 170, or for audible sound from a remotely located smoke detector and alarm to be received by a microphone mounted on one of the circuit boards 172, as described above in the various aspects of the alarm.

Figure 15C:
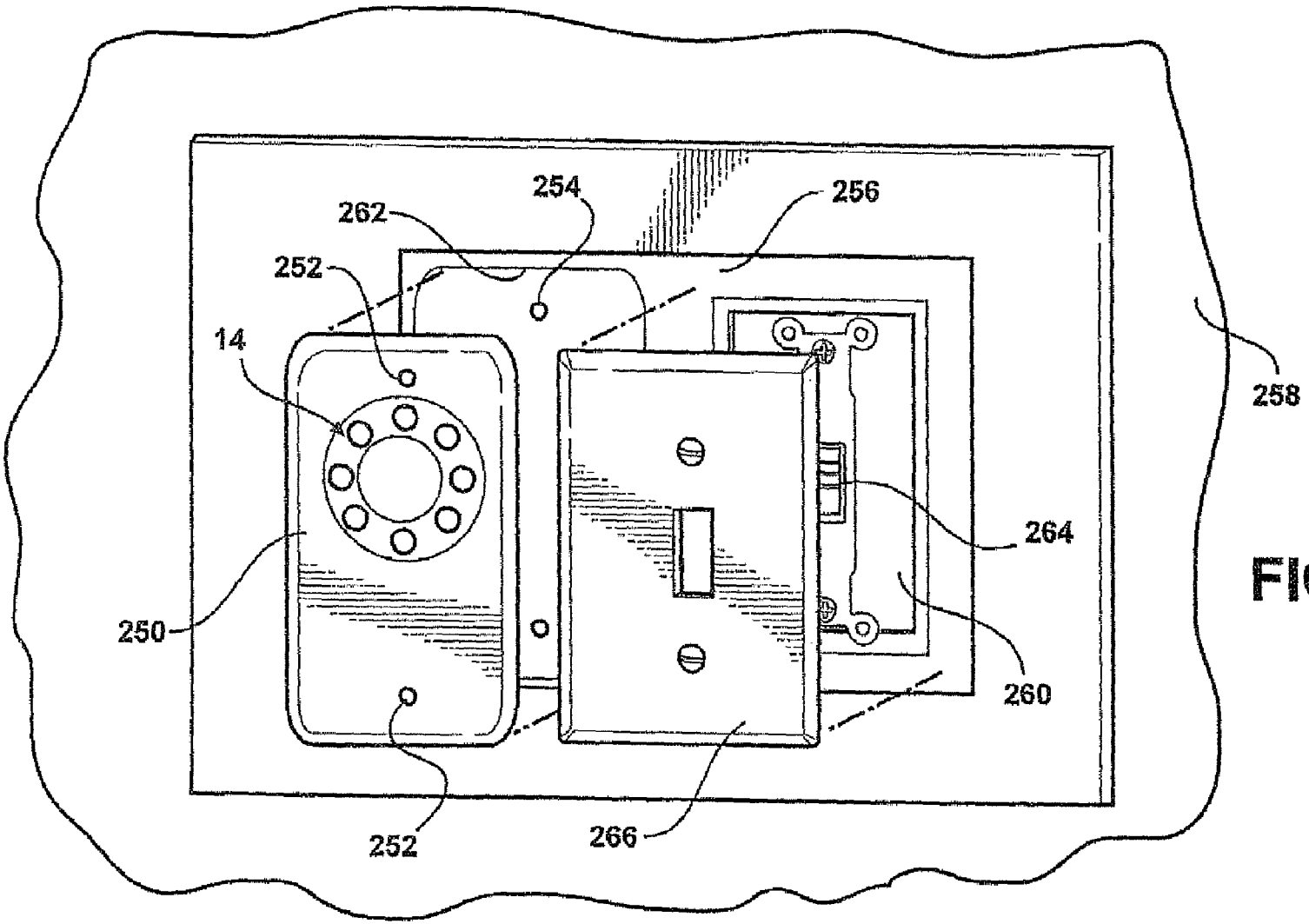
FIG. 15C is a partially-exploded, perspective view of another aspect of a box mount for an alarm shown in FIGS. 3 and 11 used in conjunction with an electrical switch.

Another mounting arrangement for the alarm 14 is shown in FIG. 15C. In this aspect, the alarm 14 is mounted on a modified junction box cover plate 250 as described above and shown in FIG. 15A. The cover plate 250 is securable by fasteners extendable through apertures 252, for example, into aligned apertures 254 in a faceplate 256. The faceplate 256 can be mounted on a wall surface 258 over an opening behind which is fixed a typical wall junction box 260 by the same fasteners used to mount the cover plate 250 on the faceplate 256 or by separate fasteners to the electrical devices mounted in the junction box 260. An optional recess 262 may be formed in one portion of the faceplate 256 to receive the cover plate 250 carrying the alarm 14.

The faceplate 256 is formed large enough to cover one or more additional electrical devices, such as a switch 264 shown by example only in FIG. 15C, an electrical outlet, combinations of switches and outlets or multiple switches and outlets mounted in the junction box 260. The elongated rectangular arrangement of the faceplate 256 can also be replaced with a more square arrangement of the cover plate 250 and cover plates 266 mountable over and exposing the operable elements of the switch 264 or the electrical plug outlet.

In the mounting arrangement shown in FIG. 15C, the alarm 14 can be easily mounted adjacent to the wall-mounted light switch 264 which is used to control lighting within a room or an enclosure and which is typically mounted adjacent the side edge of the door of the room. Since the alarm 14 is carried solely on the faceplate 256, the existing wall switch 264 and its cover plate 266 may still be employed without modification.

Figure 15D:
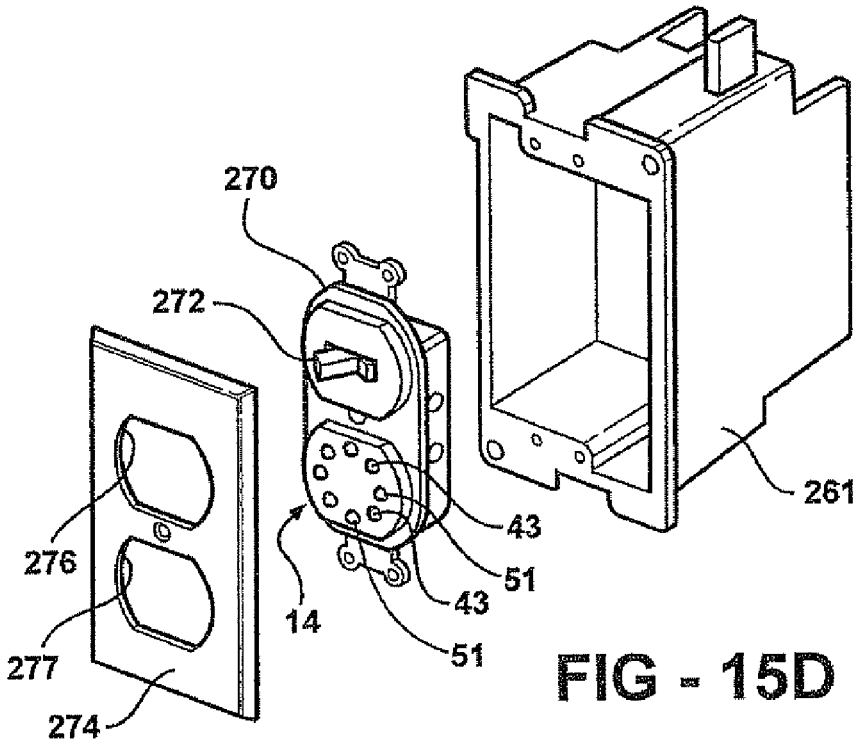
FIGS. 15D and 15E are exploded, perspective views of another aspect of a box mount for an alarm shown in FIGS. 3 and 11 where, the alarm is mounted on a switch or outlet body typically mounted in a wall junction box and covered by a cover plate.
Figure 15E:
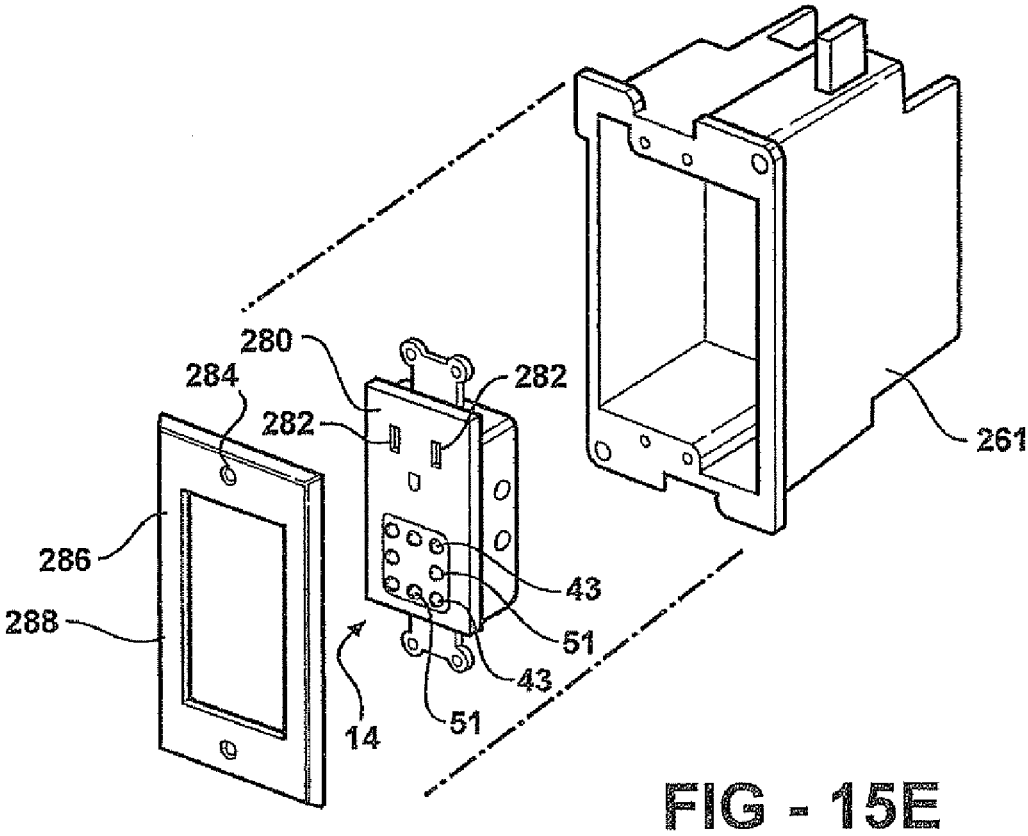

Referring now to FIGS. 15D and 15E, another mounting arrangement for the alarm 14 is depicted. Both FIGS. 15D and 15E depict a wall-mounted junction box 261. A duplex-shaped electrical device body 270 an on/off switch 272 on one end location. The alarm 14 is mounted in the other end of the body 270. The body 270 is mounted by fasteners to the junction box 261. A cover plate 274 with two apertures 276 is fixed by fasteners, not shown, to the body 270, thereby allowing the operating member of the switch 272 to protrude through one opening 276 and the lights on the alarm 14 to be visible through another aperture 277.

FIG. 15E depicts a similar arrangement in which an electrical device body 280 has a conventional electrical outlet plug 282 in one end location. The alarm 14 is mounted at a spaced end location on the body 280. The body 280 is securely mounted in the junction box 261 by fasteners 284 which can also be used to mount a cover plate 286 carrying a single, enlarged aperture 288 on the junction box 261. The aperture 288 allows access to the plug 282 and renders the lights on the alarm 14 visible.

Figure 16:
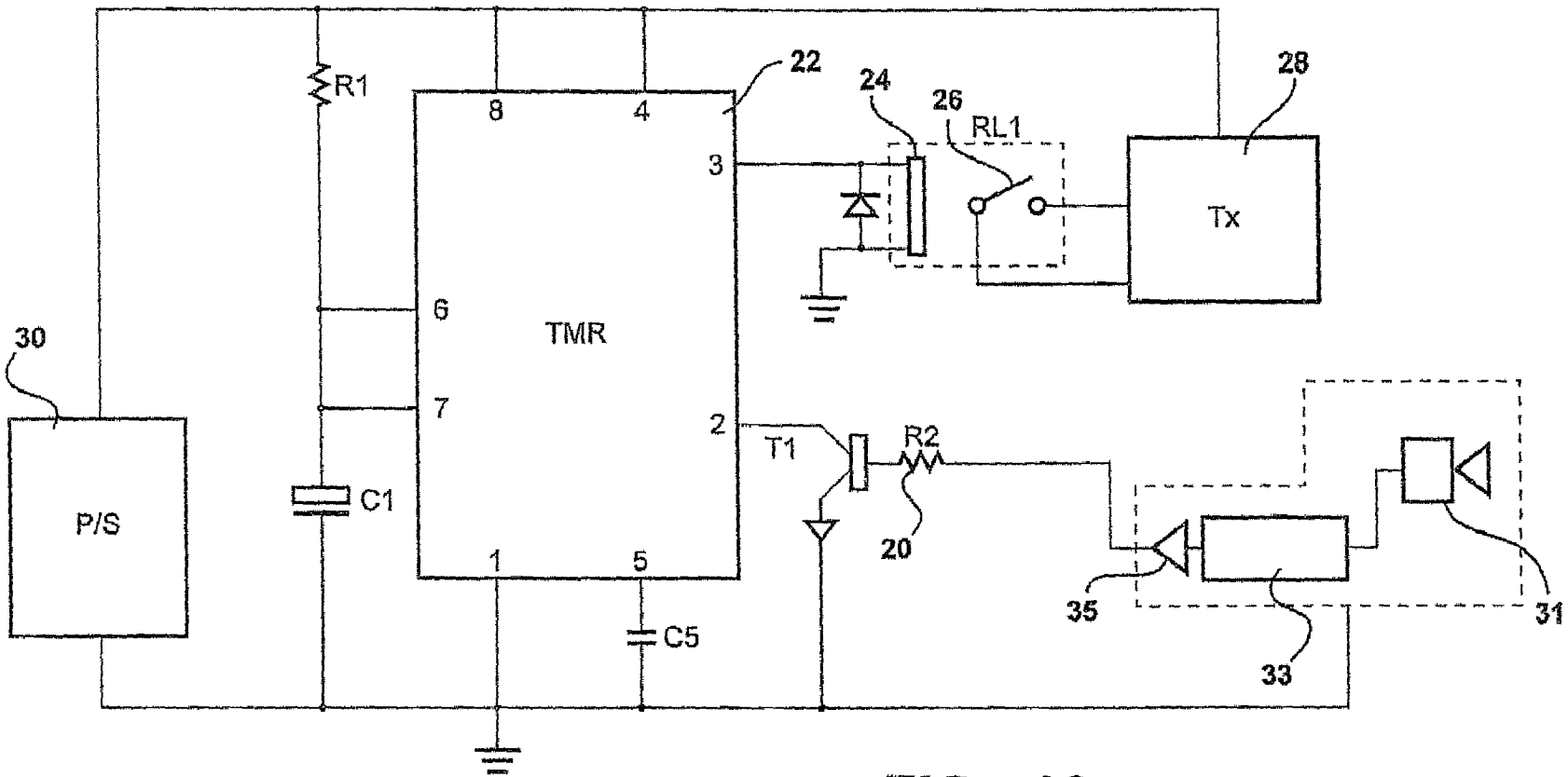
FIG. 16 is a schematic diagram of another aspect of the receiver circuit.

In yet another aspect, a receiver/sender circuit shown in FIG. 16 is configured for receiving the audible signal frequency generated by the sound generator in the alarm 12, such as a smoke, heat or carbon monoxide detector, when the alarm 12 detects smoke, etc. in the room or enclosure. Typically, the alarm sound frequency generated by an alarm 12 is approximately 85 db at 2 Hz. A sound responsive device, such as a microphone 31, is mounted in a housing 216 for receiving audible sound within a prescribed sound frequency band or sound intensity within the enclosure. The signal frequencies received by the microphone 31 are input to a notch filter 33 which is configured for passing only those frequencies associated with the smoke detector audible output, such as 2 Hz. The output of the filter 33 passes through a diode 35, whose output 20 is connected through resistor R2 to the base of transistor T1 and drives transistor T1 into conduction which brings pin 2 of a timer 22 low or to ground. The timer 22 may be any conventional timer, such as an integrated circuit timer model No. NE555P. The purpose of the timer 22 is to stretch the 2 Hz output signal 20 from the notch filter 33. Any output time period may be selected by the use of appropriate sized resistor R1 and capacitor C1. The signal frequency or frequencies passed by the notch filter 33 can be adjusted to coincide with the audible output frequency of any smoke detector. As also shown in FIG. 2, capacitor C5 is connected between one pin of the timer 22 and ground and acts as a spike arrester.

As soon as pin 2 of the timer 22 goes low or to ground, output pin 3 of the timer 22 goes high for a time period set by resistor R1 and capacitor C1 connected to input pins 6 and 7, respectively, of the timer 22. For example, appropriate values are selected for R1 and C1 to create a 5 second time period output. Thus, in this example, the output on pin 3 of the timer 22 goes high for five seconds and activates a coil 24 of a relay RL1. When the coil 24 is activated, the switchable contact 26 of the relay RL1 closes and connects power to the trigger pin of a transmitter 28.

The transmitter 28 is a transmitter capable of generating a selected frequency signal. Ultrasonic frequencies can be employed to prevent interference or unintentional activation of the alarm by other frequency signals which are commonly employed in other devices found in a home or building, such as garage door openers, television remote controls, etc. Other signal frequencies, such as radio frequencies, may also be output by the transmitter 28.

If, at the end of the five second time period, the audible output of the alarm 12 is still received, the output signal 20 from the notch filter 33 will still be present thereby causing the timer 22 to restart a new time period and continue to supply a high output from pin 3 to maintain the coil 24 of relay RL1 activated and the transmitter 28 continuing to transmit the selected frequency signal.

The microphone 31 can sample continuously for detector output, or sample the detector output on a selectable time interval, i.e., 15, 30, 45, 60 seconds, etc., for example, to conserve battery power.

Figure 18:
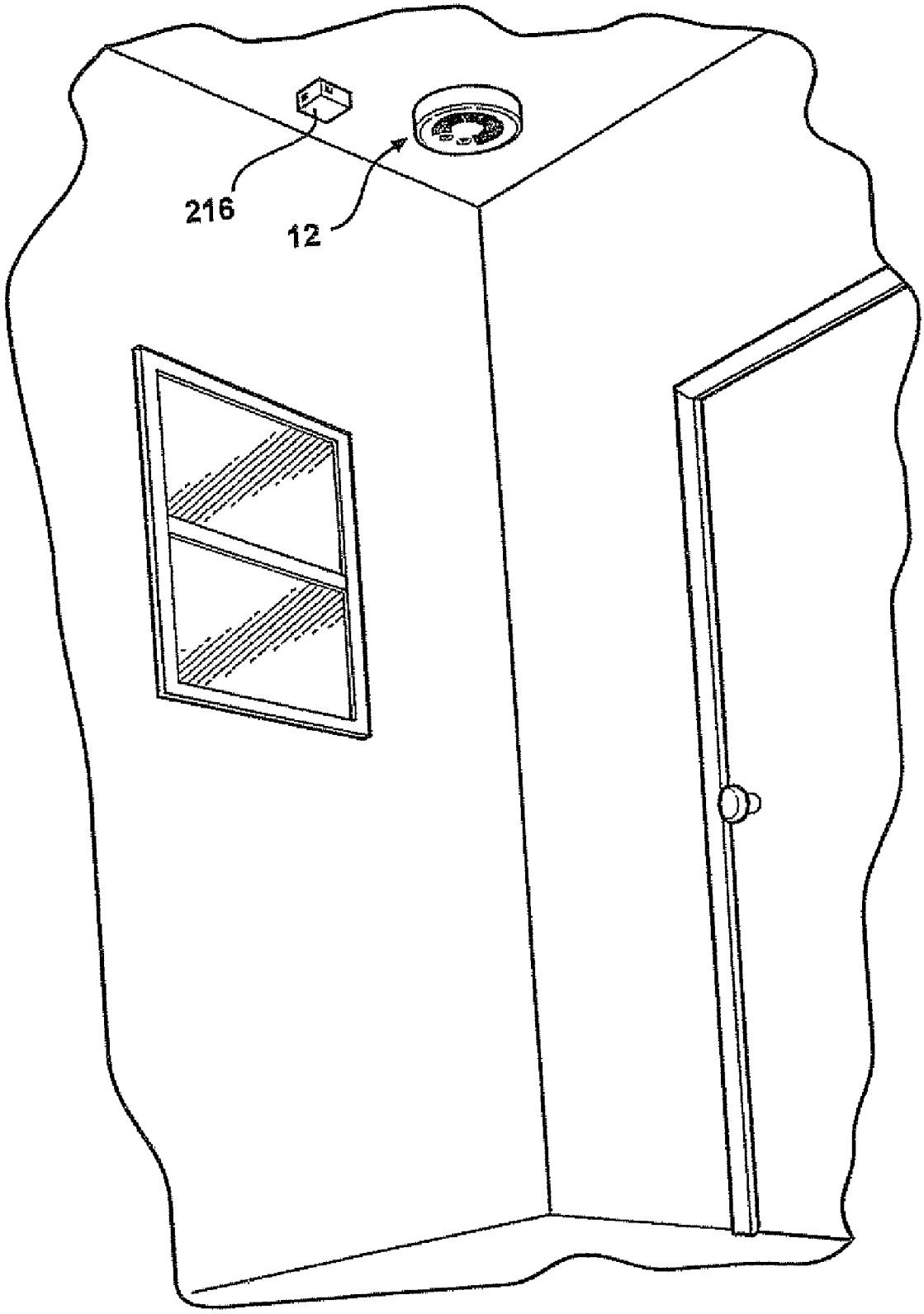
FIG. 18 is a perspective, pictorial representation of an alternate mounting position of the receiver/transmitter.

One sound receiver/sending unit 216 is mounted within signal frequency range of the smoke alarm 12, such as on the ceiling immediately adjacent to the smoke detector, as seen in FIG. 18, or at any other convenient location where the unit 216 is still capable of receiving and responding to the output signal frequency or sound intensity generated by the smoke detector 12 when the smoke alarm 12 is activated upon detecting smoke within the room or enclosure.

With the smoke alarm 12, the alarm(s) 14 and the detector 216 all in a power "on" state, the smoke alarm 12 will generate an output signal upon detecting smoke within an internal chamber within the smoke alarm 12, which signal is received by the detector 216 which causes the transmitter 28 to generate a signal which is transmitted over an area, such as through an entire room or up to 100 feet, for example, from the smoke alarm 12, and is received by all of the alarms 14 within the range of the detector 216.

Figure 19:
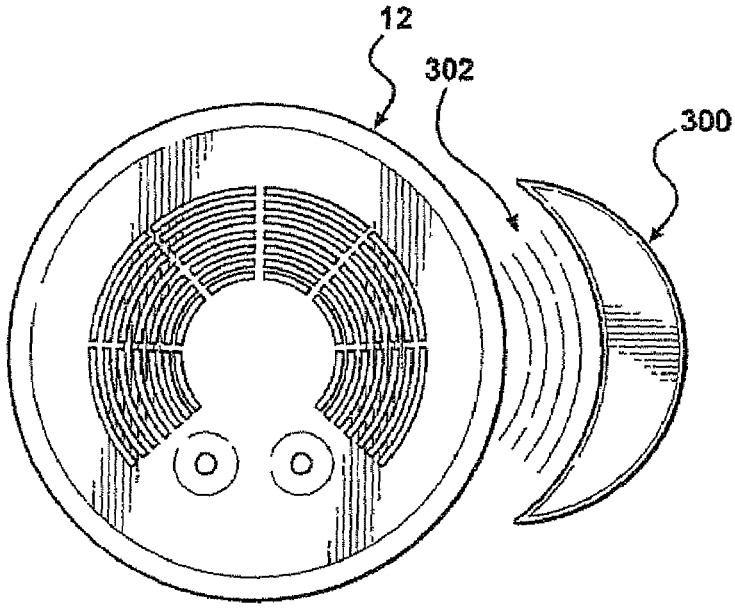
FIG. 19 is a front elevational view showing another aspect of a detector and a transmitter for an emergency event detector.

Another aspect of a sound receiver/sending unit 300 is shown in FIG. 19. In this aspect, the receiving/sending unit 300 is mounted adjacent to the emergency event alarm 12, which is depicted in FIG. 19 as being a smoke alarm for example only. The audible sound generated by the smoke alarm 12 when smoke is detected generates sound waves 302 which are received by the microphone 31 mounted in the housing 300. The circuitry shown in FIG. 16 may be mounted in the housing 300 to detect the audible output of the smoke alarm 12 to activate the transmitter 28 to generate a selected frequency signal which can be detected by the remote alarm.

Figure 17:
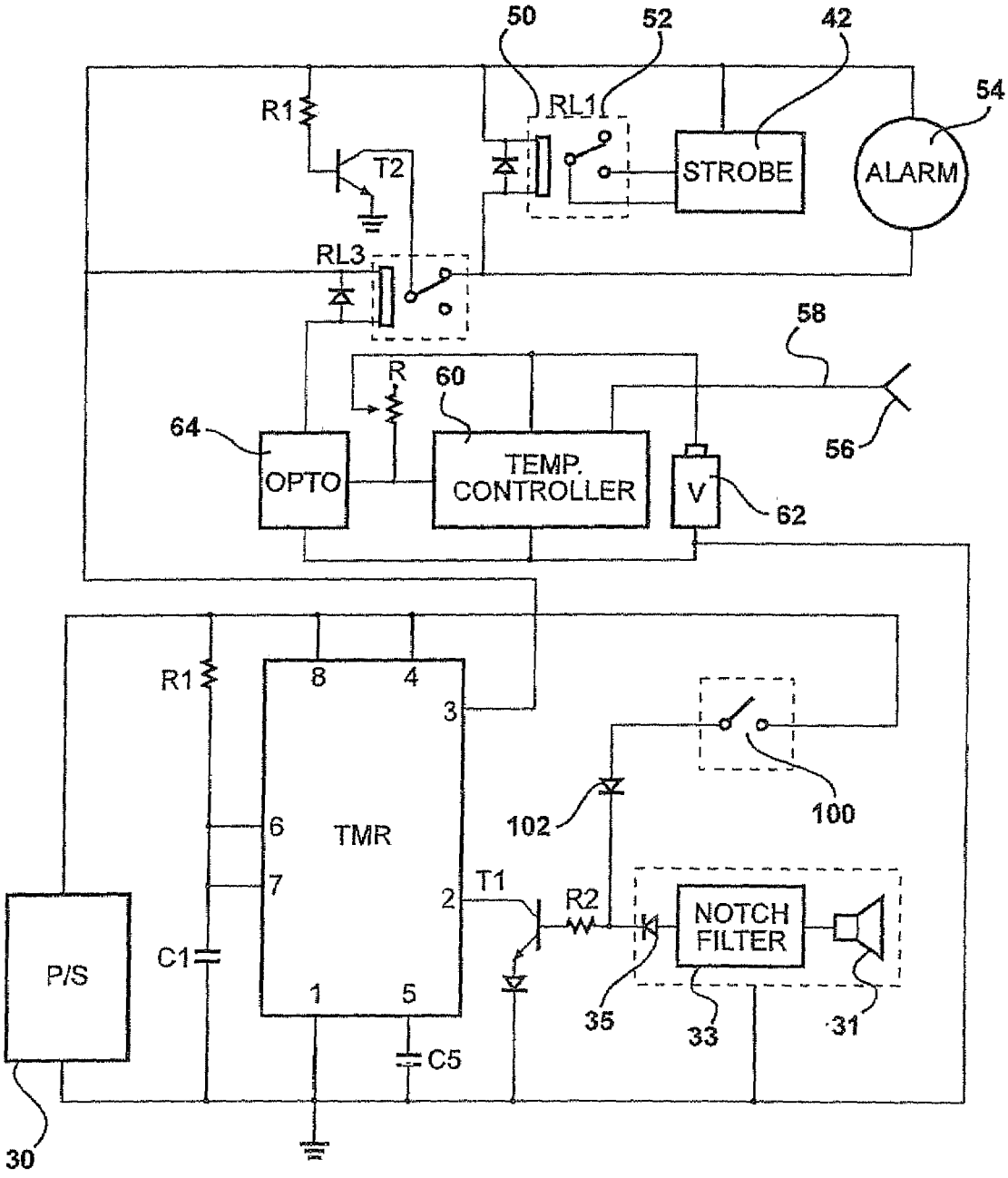
FIG. 17 is a schematic diagram of a combined receiver and alarm circuit.

Referring now to FIG. 17, there is depicted another aspect in which the receiving/sending unit 216 and the alarm 14 are combined into a single housing. Most of the circuit components shown in FIG. 17 are identical to and function in the same manner as the corresponding component in the receiver circuit shown in FIG. 16 and the alarm circuit shown in FIG. 3, except that the transmitter 28 and the receiver 48 are eliminated. In the combined circuit shown in FIG. 17, a signal frequency or sound intensity received by the microphone 31 and the notch filter 33, which corresponds to the pre-selected output signal frequency of an activated smoke alarm 12, activates a signal from the timer 22 which energizes the coil of relay of RL1 causing the contact 52 of the relay RL1 to close connecting electric power to the strobe 42 and the audible alarm 52 in the same manner as described above.

The combined circuit may optionally include the temperature controller 60 which is used to detect the ambient temperature of the surface surrounding adjacent to the alarm housing.

The combined circuit eliminates the need for a separate unit 216 adjacent the alarm 12. The only requirement for use of the combined unit 16 is that the housing carrying the modified receiving circuit needs to be mounted within signal receiving range of the audible output signal of the smoke alarm 12.

In any of the mounting positions of the alarm 14 shown in FIG. 18, the alarms 14 can utilize the combined detector and alarm circuit shown in FIG. 17.

In another aspect, the receiver includes an audible frequency receiver, such as a microphone and a filter selected to detect the output audible signal frequency of a smoke or carbon monoxide detector. The detector output is connected to the transmitter which sends an activation signal to the remotely located alarm to activate the alarm.

Figure 22:
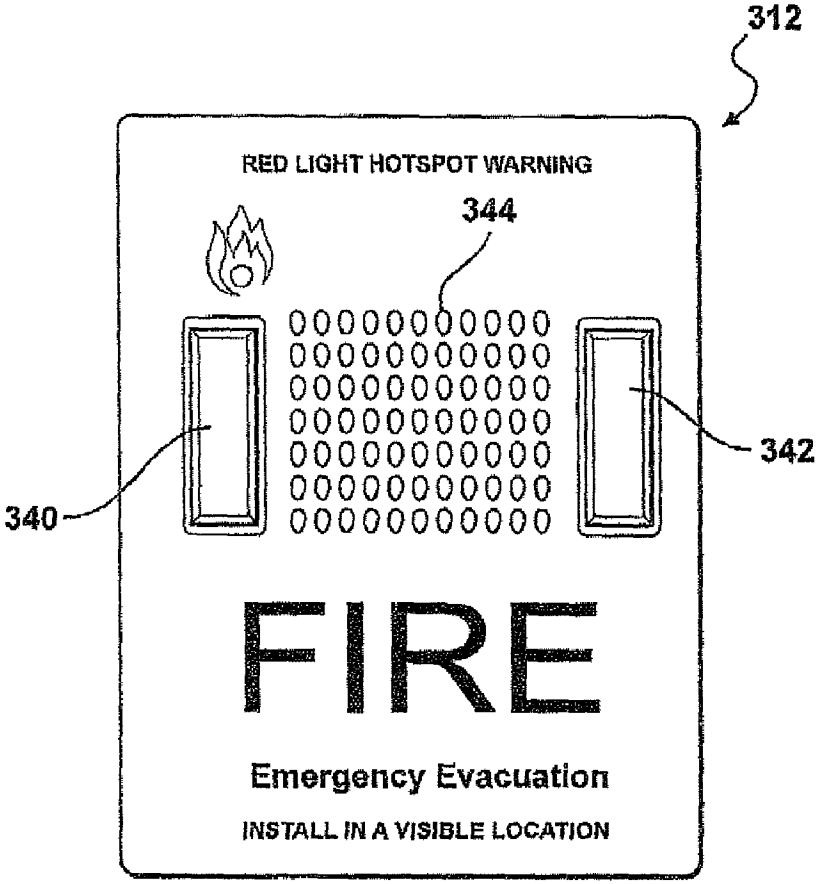
FIG. 22 is another aspect of a remote alarm using multiple flash tubes.
Figure 21:
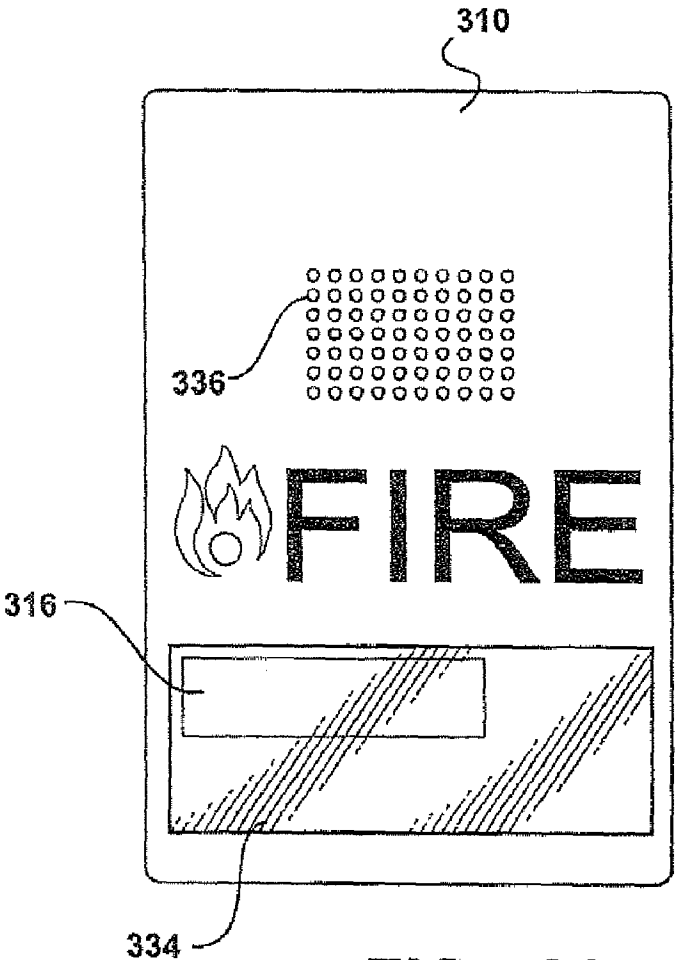
FIG. 21 is a front elevation view of another aspect of a remote alarm using at least one flash tube as the light source.
Figure 23C:
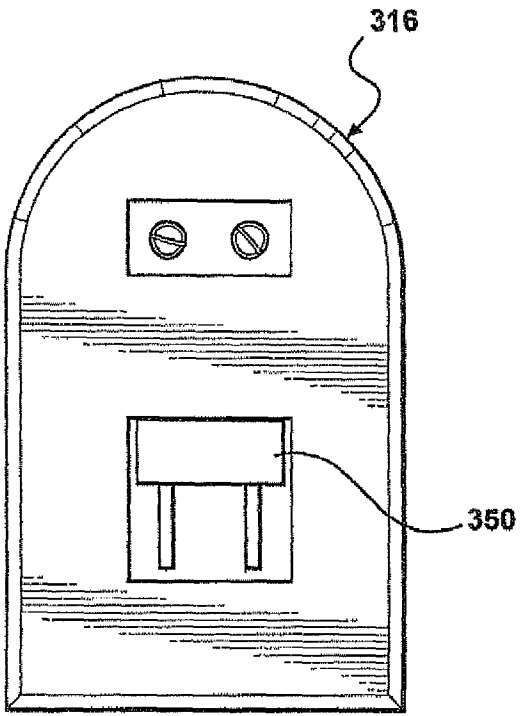
FIGS. 23A, 23B, and 23C are front, side and rear elevations, respectively, of another aspect of a remote alarm.
Figure 23B:
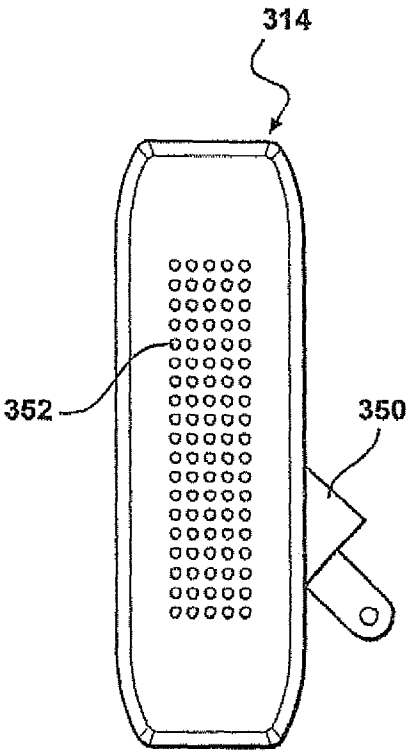
Figure 23A:
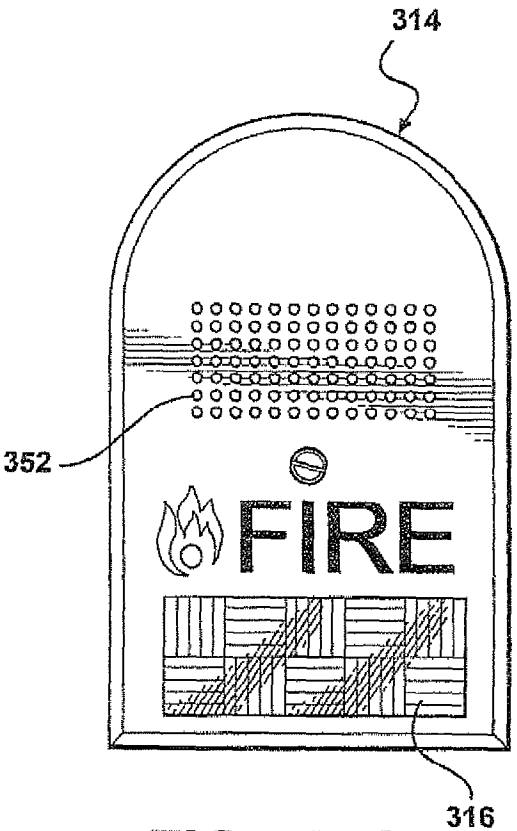

In place of the LEDs flash as the lights 43 tubes may be employed as the white light generating pulsed strobe in the alarm units such as examples of alarm units 310, 312 and 314 shown in FIGS. 21, 22, and 23A.

Figure 20:
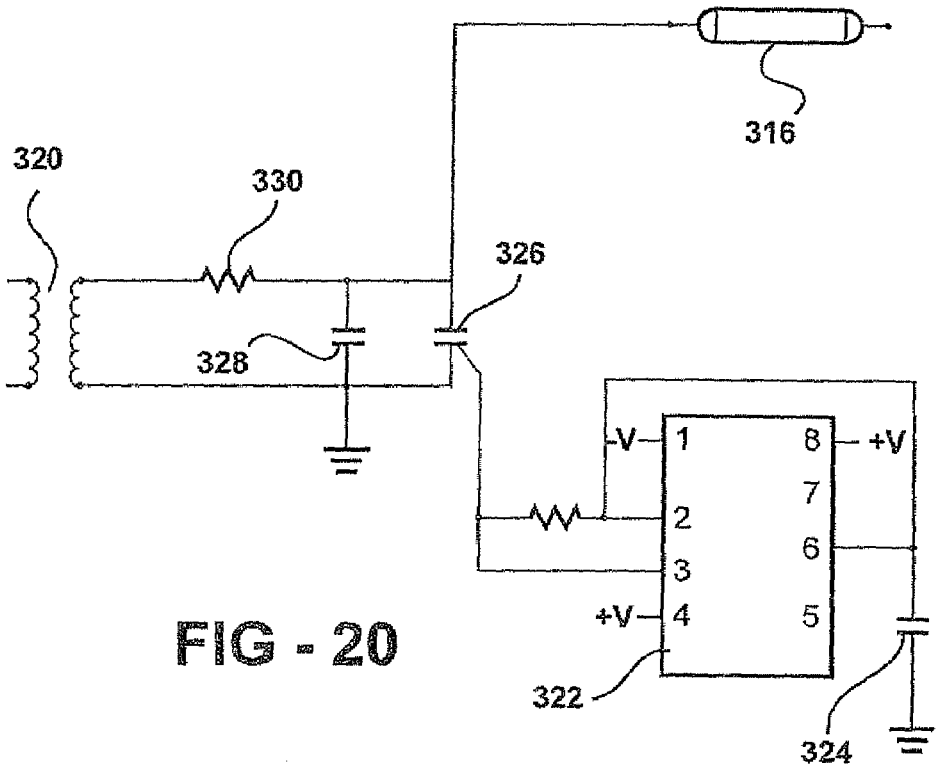
FIG. 20 is a circuit modification implementing flashtubes instead of LEDs in the circuit shown in FIG. 3.

Flash tubes typically come in elongated, tubular shape or a U-shape. Either or both shapes may be used in the alarm units 310, 312, and 314. Typically, the longer the length of the flash tube, the more light or candela units are produced. The alarm circuit shown in FIG. 17 needs to be modified for a flash tube 316 by incorporating the circuit shown in FIG. 20. The input or activation signal to the strobe light 42 shown in FIG. 17 can be applied to a step-up transformer 320 which steps up the anode voltage to the flash tube 316 to 300 volts, for example. A timer integrated circuit 322, such as a 555 timer, can be employed in the flash tube triggering circuitry to provide the flash rate for the use of a flash tube 316 as a pulsed strobe. A timing capacitor 324 is coupled to the timer 322 along with the output of a switch, such as a SCR 326. An SCR from Radio Shack, Model No. 276-1020 may be employed.

The switch 326 is connected across of in parallel with a trigger capacitor 328 which has a positive end connected through resistor 330 to the positive side of the transformer 320. The negative side of the trigger capacitor 328 is connected to ground. The resistor 330 and the timer capacitor 324 control the pulse or flash frequency.

As shown in FIG. 21, at least one flash tube 316 is mounted in the housing of the alarm 310. By way of example only, at least a portion 334 of the cover or faceplate of the housing 310 is made transparent for visibility of the flash tube 316.

In the alarm 312, shown in FIG. 22, a lens cap 340 covers a white light generating flash tube 316. At least one second, different colored lens cap 342, which may be yellow, for example only, is also mounted on the cover or front of the housing of the alarm 312. Apertures 344 are also formed in the front wall or cover of the housing of the alarm 312 to allow the broadcast of verbal messages or audible alarms as described hereafter.

The second lens cap 342, as described above, is of a different color than the color of the lens cap 340. The lens caps 340 and 342, which are disposed over separate flash tubes, for example, function in the same manner as the different colored LEDs 43 and 51 described above, with the light emitted through the lens cap 342 depicting a caution or threshold temperature of 120° F., for example, sensed by the temperature sensor within the alarm 312 of the ambient environment surrounding the alarm 312. When illuminated, the light from the lens 342 urges caution in using the adjacent exit.

Optionally, when a higher threshold temperature is sensed by the temperature sensor may be, such as a 135° F. or higher, for example, both flash tubes under the lenses 340 and 342 are extinguished thereby indicating that the adjacent exit should not be used as an escape route.

Both of the alarms 310 and 312 have onboard storage batteries for power. The alarms 310 and 312 may be alternately connected to a power supply through use of any of the mounting plate/wall junction box mounting arrangements as described above.

It is also possible, as shown in FIGS. 23A, 23B, and 23C, to construct the alarm 314 with a plug 350 which can be connected to an 110 volt A.C. wall outlet to supply power to an onboard transformer or other power conversion device to enable electronics on the circuit boards mounted within the alarm 314 to function. It will be understood that the 110 volt plug 350, which can be a pivotal or flip out plug, may be employed with any aspect of the alarms described in this specification.

The alarm 314 also has a plurality of apertures 352 on the front and/or side surfaces of the housing. The apertures 352 just like the apertures 344 and 336 in the alarms 312 and 310 and the apertures in any of the alarms 14, etc. described above allow ambient air to enter the interior of the alarm to enable the temperature sensor to detect the temperature of the ambient air. At the same time, the apertures, such as apertures 352, provide openings for broadcasting of recorded messages from the alarm 314. The audible siren which can generate audible emergency tones or the above-described warbling emergency sound can be mounted in the alarms 310, 312, or 314. Alternately, in combination with the audible emergency sound or separately, a recorded voice message may be stored on a voice chip mounted on the circuit boards mounted in the alarm 314. In general, voice chips and associated circuitry allow verbal messages to be received, converted to digital form and stored in a memory for subsequent broadcast. Any message can be stored, such as, for example, "danger, danger, exit immediately." A particular exit, such as the one immediately adjacent the housing generating the voice command may be identified in a message, such as "exit through this door immediately."

The voice message may be pre-recorded and pre-stored by the manufacturer as a standard message. Alternately, circuitry may be employed to allow the customer to prerecord an emergency message in his or her own voice to make the message more suitable for their children which may calm the child down during the emergency situation and more readily cause the child to follow the voice instructions to exit the room through a particular door or other egress means.

What is claimed is:

1. An emergency notification and directional signaling escape indicator apparatus usable with an emergency event detector generating a first signal output upon detecting an emergency event, the apparatus usable with at least one escape exit and comprising:

a detector capable of generating a signal upon sensing an output signal from the emergency event detector;

a transmitter responsive to the detector signal from the detector for generating a first signal frequency;

at least one housing adapted to be mounted on a surface in proximity to an escape exit;

an alarm providing at least one of an audible alarm and a visual alarm;

a receiver generating an output signal in response to the first signal frequency activating the alarm upon receiving the first signal frequency the alarm and the receiver carried in the housing; and a temperature sensor, carried in the housing, for sensing the ambient temperature adjacent to the housing, the temperature sensor generating an output signal upon detecting a temperature above a predetermined threshold temperature, the output signal activating at least one of a second notification and directional signaling event.

2. An emergency notification and directional signaling escape indicator apparatus usable with a detector generating an output at a first signal frequency upon detecting an emergency event, the apparatus mountable adjacent at least one escape exit, the apparatus comprising:

a receiver remote from the emergency event detector and capable of generating an output signal upon sensing a first signal from the emergency event detector;

a transmitter responsive to the output signal of the receiver for transmitting a second signal frequency upon receiving the output signal from the receiver;

at least one distinct alarm carried in a housing remotely mounted from the transmitter and adapted to be mounted on a surface in close proximity to the escape exit, the alarm including a stored voice message;

a receiver, carried with the alarm and responsive to the second signal frequency from the transmitter, the receiver activating the alarm upon receiving the second signal frequency from the transmitter; and a temperature sensor, carried with the housing, for sensing the ambient temperature adjacent to the housing, the temperature sensor generating an output signal upon detecting a temperature above a predetermined threshold temperature, the output signal activating at least one of a second notification and directional signaling event.

3. The apparatus of claim 2 wherein the temperature sensor comprises a thermistor.

4. The apparatus of claim 2 wherein the alarm comprises:

at least one of a visible light from a first light source and an audible alarm.

5. The apparatus of claim 4 wherein the visible light comprises a pulsed strobe.

6. The apparatus of claim 5 wherein the pulsed strobe is a white light strobe.

7. The apparatus of claim 2 further comprising:

the receiver and the temperature sensor mounted in the housing.

8. The apparatus of claim 7 wherein the alarm comprises both a visible light and an audible alarm.

9. The apparatus of claim 2 wherein the receiver includes:

a sound detector generating an output upon receiving a signal frequency; and a filter responsive to the sound detector output for passing only signal frequencies corresponding to the first signal frequency from the transmitter.

10. The apparatus of claim 2 further comprising:

a first switch responsive to an output of the receiver for activating the alarm; and a second switch, responsive to the output signal of the temperature sensor at a preset threshold temperature, for operating the first switch to deactivate the alarm.

11. The apparatus of claim 2 further comprising:

a test transmitter generating a test signal frequency when activated; and the receiver in the housing activating the alarm upon receiving the test signal frequency.

12. The apparatus of claim 2 wherein:

the housing is mountable in an electrical power outlet box.

13. The apparatus of claim 2 wherein:

the housing includes a plug insertable in an electrical power receptacle.

14. The apparatus of claim 13 wherein the electrical power receptacle provides 110V AC electrical power.

15. The apparatus of claim 14 further comprising:

electrical power storage backup mounted in the housing for supplying backup electric power to the alarm.

16. The apparatus of claim 2 further comprising:

the housing is a portable housing adapted to be removably mounted in proximity with the escape exit.

17. The apparatus of claim 2 wherein:

the receiver and the transmitter are disposed in one housing.

18. The apparatus of claim 2 wherein:

electric power for the receiver in the alarm in the housing is provided by storage batteries.

19. The apparatus of claim 13 wherein:

the plug is pivotally mounted on the housing for movement between a first, non-contact position substantially surrounded by a portion of the housing to a second electrically connectible position wherein the plug extends outward from the housing.

20. The apparatus of claim 2 wherein:

the alarm is an audible alarm generating a warble sound.

21. The apparatus of claim 2 wherein the voice message is at least one of a prerecorded message and a recordable message.

22. The apparatus of claim 2 wherein the alarm comprises:

at least one flash tube.

23. The apparatus of claim 2 wherein:

the housing has at least a portion allowing light to be emitted from a first visible alarm light source through the portion in a first color.

24. The apparatus of claim 22 further comprising:

a first lens mounted in the housing and disposed to allow emission of light from the first light source in the first color.

25. The apparatus of claim 24 wherein the alarm further comprises:

a second light source mounted in the housing; and a second colored lens, formed of a second different color than the first lens, for converting the light emitted by the second light source to a different color light than the light emitted by the first light source through the first lens.

26. The apparatus of claim 2 wherein the alarm further comprises:

a first and second light source;

a first surface disposed over the first light source for allowing light to be emitted from the first light source in a first color; and a second surface disposed over the second light source for allowing light to be emitted from the second light source in a second color different from the first color.

27. The apparatus of claim 2 wherein the alarm further comprises:

the at least one of the second emergency notification and directional signaling event activated by the temperature sensor output.

28. The apparatus or claim 27 wherein the second event comprises one of a second different color light and a second different audible sound.

29. The apparatus of claim 28 wherein the second audible sound is a stored voice message.

30. The apparatus of claim 2 wherein the housing further comprises:

vents formed in the housing allowing airflow to the temperature sensor within the interior of the housing.

31. The apparatus of claim 2 further comprising:

the receiver mounted in the housing adapted for detecting the sound frequency output of an emergency event detector alarm.

32. The apparatus of claim 31 wherein the housing further comprises:

an emergency event detector mounted in the housing for separately detecting an emergency event; and the detector generating an output to activate the alarm in the housing.

33. The apparatus of claim 31 wherein:

the housing is mounted on one location of an electrical duplex body; and at least one of a switch and an electrical plug receptacle is mounted on another location of the electric duplex body.

34. An emergency notification and directional signaling escape indicator apparatus usable with a detector generating an output at a first signal frequency upon detecting an emergency event, the apparatus mountable adjacent at least one escape exit, the apparatus comprising:

a receiver remote from the emergency event detector and capable of generating an output signal upon sensing a first signal from the emergency event detector;

a transmitter responsive to the output signal of the receiver for transmitting a second signal frequency upon receiving the output signal from the receiver;

at least one distinct alarm carried in a housing remotely mounted from the transmitter and adapted to be mounted on a surface in close proximity to the escape exit;

the housing is adapted to be mounted inside an electrical junction box; and a receiver, carried with the alarm and responsive to the second signal frequency from the transmitter, the receiver activating the alarm upon receiving the second signal frequency from the transmitter.

35. The apparatus of claim 34 further comprising:

the junction box further adapted for fixedly receiving at least one of an electrical plug receptacle and an electric switch.

36. An emergency notification and directional signaling escape indicator apparatus usable with an emergency event alarm activated upon detecting an emergency event comprising:

a housing adapted to be mounted inside an electrical junction box;

a receiver capable of generating a signal upon sensing activation of the emergency event alarm;

an alarm, responsive to the receiver signal, providing at least one of an audible alarm and a visual alarm;

the alarm and the receiver carried in the housing; and a temperature sensor, carried in the housing, for sensing the ambient temperature adjacent to the housing, the temperature sensor generating an output signal upon detecting a predetermined threshold temperature, the output signal activating at least one of a second notification and directional signaling event.

37. The apparatus of claim 36 wherein:

the housing is mounted on one location of an electrical duplex body; and at least one of a switch and an electrical plug receptacle is mounted on another location of the electric duplex body.

38. The apparatus of claim 36 further comprising:

the junction box adapted for fixedly receiving at least one of an electrical plug receptacle and an electric switch.

39. An emergency notification and directional signaling escape indicator apparatus usable with a detector generating an output at a first signal frequency upon detecting an emergency event, the apparatus mountable adjacent at least one escape exit, the apparatus comprising:

a receiver remote from the emergency event detector and capable of generating an output signal upon sensing a first signal from the emergency event detector;

a transmitter responsive to the output signal of the receiver for transmitting a second signal frequency upon receiving the output signal from the receiver;

at least one distinct alarm carried in a housing remotely mounted from the transmitter and adapted to be mounted on a surface in close proximity to the escape exit, the alarm including a stored voice message and at least one of an audible alarm and a visual alarm; and a receiver, carried with the alarm and responsive to the second signal frequency from the transmitter, the receiver activating the alarm upon receiving the second signal frequency from the transmitter.

40. The apparatus of claim 39 wherein:

the alarm is activatable by a distinct second one of an audible alarm, a visual alarm and a stored voice message as a second notification and directional signaling event.

* * * * *